US008929777B2

(12) United States Patent
Yamabe et al.

(10) Patent No.: US 8,929,777 B2
(45) Date of Patent: Jan. 6, 2015

(54) SIEVE DEVICE, SUPPLY UNIT, DEVELOPING UNIT, IMAGE FORMING APPARATUS, AND METHOD OF SUPPLYING TONER PARTICLES

(71) Applicants: Junji Yamabe, Shizuoka (JP); Hideo Ichikawa, Shizuoka (JP); Seiji Terazawa, Shizuoka (JP); Masashi Hasegawa, Shizuoka (JP)

(72) Inventors: Junji Yamabe, Shizuoka (JP); Hideo Ichikawa, Shizuoka (JP); Seiji Terazawa, Shizuoka (JP); Masashi Hasegawa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 6 days.

(21) Appl. No.: 13/738,090

(22) Filed: Jan. 10, 2013

(65) Prior Publication Data

US 2013/0216270 A1 Aug. 22, 2013

(30) Foreign Application Priority Data

Feb. 17, 2012 (JP) ..... 2012-033045

(51) Int. Cl.
*G03G 15/08* (2006.01)

(52) U.S. Cl.
CPC ..... *G03G 15/0846* (2013.01); *G03G 15/0879* (2013.01)
USPC ..... 399/258

(58) Field of Classification Search
CPC . G03G 15/0846; G03G 15/0879; A47J 43/22; B07B 1/20; D21D 5/026
USPC ..... 399/258, 98, 358, 359, 360; 209/301–306, 351, 358, 283, 254
See application file for complete search history.

(56) References Cited

U.S. PATENT DOCUMENTS

| | | | | | |
|---|---|---|---|---|---|
| 172,693 | A * | 1/1876 | Blair | 209/283 |
| 3,995,817 | A * | 12/1976 | Brociner | 241/30 |
| 5,486,905 | A * | 1/1996 | Takeda et al. | 399/253 |
| 5,600,411 | A * | 2/1997 | Hart | 399/98 |
| 2006/0057487 | A1 * | 3/2006 | Nagayama et al. | 430/109.4 |
| 2008/0016646 | A1 * | 1/2008 | Gagnon et al. | 15/301 |
| 2008/0022550 | A1 * | 1/2008 | Masters | 34/480 |
| 2010/0124716 | A1 * | 5/2010 | Tomioka et al. | 430/109.4 |
| 2011/0133513 | A1 * | 6/2011 | Stephens et al. | 296/190.09 |
| 2012/0234735 | A1 | 9/2012 | Ichikawa et al. | |

FOREIGN PATENT DOCUMENTS

| | | | | |
|---|---|---|---|---|
| JP | 2003-131485 | | 5/2003 | |
| JP | 2003131485 | A * | 5/2003 | G03G 15/08 |
| JP | 2006-023782 | | 1/2006 | |
| JP | 2009-090167 | | 4/2009 | |

OTHER PUBLICATIONS

Machine translation of Takami, JP 2003-131485.*
U.S. Appl. No. 13/738,070, filed Jan. 10, 2013, Yamabe, et al.
U.S. Appl. No. 13/738,108, filed Jan. 10, 2013, Yamabe, et al.

* cited by examiner

*Primary Examiner* — David Gray
*Assistant Examiner* — Sevan A Aydin
(74) *Attorney, Agent, or Firm* — Oblon, Spivak, McClelland, Maier & Neustadt, L.L.P.

(57) ABSTRACT

A sieve device is provided. The sieve device includes a sieve body and an introduction unit. The sieve body includes a cylinder, a filter, and a blade. The cylinder is adapted to be supplied with toner particles. The filter is disposed at a bottom of the cylinder. The blade is adapted to agitate the toner particles within the cylinder to allow the toner particles to pass through the filter. The blade is rotatable about a rotation axis that intersects with the filter in proximity to the filter. The introduction unit is adapted to introduce the toner particles passed through the filter outside the sieve body.

16 Claims, 16 Drawing Sheets

SIEVE DEVICE, SUPPLY UNIT, DEVELOPING UNIT, IMAGE FORMING APPARATUS, AND METHOD OF SUPPLYING TONER PARTICLES

CROSS-REFERENCE TO RELATED APPLICATIONS

This patent application is based on and claims priority pursuant to 35 U.S.C. §119 to Japanese Patent Application No. 2012-033045, filed on Feb. 17, 2012, in the Japan Patent Office, the entire disclosure of which is hereby incorporated by reference herein.

BACKGROUND

1. Technical Field

The present disclosure relates to a sieve device, a supply unit including the sieve device, a developing unit including the supply unit, an image forming apparatus including the developing unit, and a method of supplying toner particles.

2. Description of Related Art

Image forming apparatuses which form images by developing electrostatic latent images with toner are known. In particular, it is widely known that electrophotographic image forming apparatuses form images by developing electrostatic latent images into toner images with toner and transferring and fusing the toner images on paper. Such image forming apparatuses are generally equipped with a developing device that develops electrostatic latent images into toner images. JP-2003-131485-A describes a supply device that supplies toner to a developing device with a high degree of accuracy.

Recently, small-sized toners are widely used for the purpose of improving image quality. Sometimes toner contains coarse particles undesirably produced in its production process or due to the occurrence of weak aggregation under high-temperature and high-humidity conditions. If containing coarse particles, toner cannot develop an electrostatic latent image into a toner image with high accuracy.

JP-2006-23782-A describes a method of removing coarse particles from toner by means of sieving. In this method, coarse particles are removed by sieving toner with a filter vibrated by ultrasonic waves. However, there is a concern that the apertures of the filter are clogged with toner particles softened by frictional heat generated due to vibration of the filter, or another concern that the apertures of the filter are enlarged by stress caused by vibration of the filter.

JP-2009-90167-A describes a sieve device having a rotation shaft, a cylindrical sieve disposed coaxially with the rotation shaft, and rotary blades attached to the rotation shaft.

Further, this sieve device has a mechanism of transporting powder from inside to outside of the cylindrical sieve. Thus, the powder is sieved only by rotating the rotary blades without vibrating the sieve.

The mechanism of transporting powder from inside to outside of the cylindrical sieve requires a large space for collecting powders passed through the sieve. Therefore, this sieve device and an image forming apparatus equipped therewith get undesirably large in size.

SUMMARY

In accordance with some embodiments, a sieve device is provided. The sieve device includes a sieve body and an introduction unit. The sieve body includes a cylinder, a filter, and a blade. The cylinder is adapted to be supplied with toner particles. The filter is disposed at a bottom of the cylinder. The blade is adapted to agitate the toner particles within the cylinder to allow the toner particles to pass through the filter. The blade is rotatable about a rotation axis that intersects with the filter in proximity to the filter. The introduction unit is adapted to introduce the toner particles passed through the filter outside the sieve body.

In accordance with some embodiments, a supply unit is provided. The supply unit includes the above sieve device and a supply device. The supply device is connected to the introduction unit so that the toner particles passed through the filter are introduced into the supply device.

In accordance with some embodiments, a developing unit is provided. The developing unit includes the above supply unit and a developing device. The developing device is adapted to develop an electrostatic latent image into a toner image with the toner particles supplied from the supply unit.

In accordance with some embodiments, an image forming apparatus is provided. The image forming apparatus includes the above developing unit, a transfer unit, and a fixing unit. The transfer unit is adapted to transfer the toner image onto a recording medium. The fixing unit is adapted to fix the toner image on the recording medium.

In accordance with some embodiments, a method of supplying toner particles is provided. In the method, toner particles are supplied to a sieve body including a cylinder, a filter disposed at a bottom of the cylinder, and a blade. The toner particles in the cylinder are agitated by rotating the blade about a rotation axis that intersects with the filter in proximity to the filter to allow the toner particles to pass through the filter. The toner particles passed through the filter are supplied to a developing device adapted to develop an electrostatic latent image into a toner image with the toner particles.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
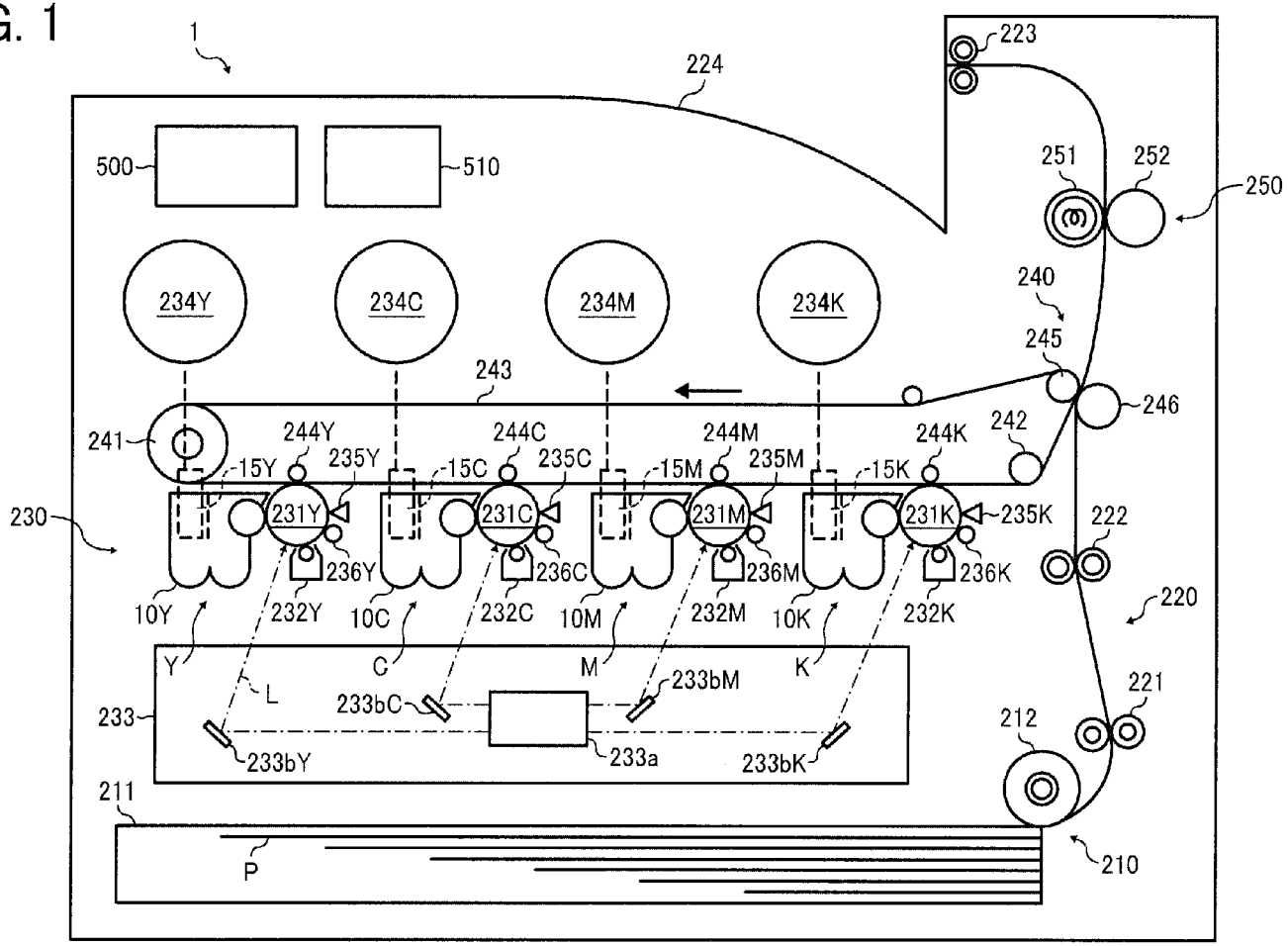
FIG. 1 is a schematic view of an image forming apparatus according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

FIG. 1 is a schematic view of an image forming apparatus according to an embodiment. An image forming apparatus 1 forms a toner image and fixes it on a recording medium, such as paper.

The image forming apparatus 1 includes a paper feed part 210, a conveyance part 220, an imaging part 230, a transfer part 240, a fixing part 250, a control part 500, and an operation panel 510.

The paper feed part 210 includes a paper feed cassette 211 that stores sheets of paper and a paper feed roller 212 that feeds the sheets one by one.

The conveyance part 220 includes a roller 221, a pair of timing rollers 222, and a paper ejection roller 223. The roller 221 feeds a sheet fed from the paper feed roller 212 toward the transfer part 240. The pair of timing rollers 222 keeps the sheet fed from the roller 221 waiting for a predetermined time period by sandwiching its leading edge, and then timely feeds it to the transfer part 240. The paper ejection roller 223 ejects the sheet, having a toner image having been fixed thereon by the fixing part 250, on a paper ejection tray 224.

The imaging part 230 includes four image forming units, i.e., from the leftmost side thereof in FIG. 1, an yellow image forming unit Y, a cyan image forming unit C, a magenta image forming unit M, and a black image forming unit K. The imaging part 230 further includes an irradiator 233. Hereinafter, any one of the image forming units Y, C, M, and K may be simply referred to as the "image forming unit".

Each of the four image forming units has substantially the same mechanical configuration as the others but contains a developer of a different color. The yellow, cyan, magenta, and black image forming units include: respective photoreceptor drums 231Y, 231C, 231M, and 231K; respective chargers 232Y, 232C, 232M, and 232K; respective toner cartridges 234Y, 234C, 234M, and 234K; respective developing units 10Y, 10C, 10M, and 10K; respective neutralizers 235Y, 235C, 235M, and 235K; and respective cleaners 236Y, 236C, 236M, and 236K. The photoreceptor drums 231Y, 231C, 231M, and 231K bear electrostatic latent images and toner images and are rotatable clockwise in FIG. 1. The chargers 232Y, 232C, 232M, and 232K uniformly charge surfaces of the photoreceptor drums 231Y, 231C, 231M, and 231K, respectively. The toner cartridges 234Y, 234C, 234M, and 234K supply toners of yellow, cyan, magenta, and black, respectively. The developing units 10Y, 10C, 10M, and 10K develop electrostatic latent images formed on the photoreceptor drums 231Y, 231C, 231M, and 231K, respectively, by the irradiator 233 with the toners supplied from the toner cartridges 234Y, 234C, 234M, and 234K, respectively. The neutralizers 235Y, 235C, 235M, and 235K neutralize the surfaces of the photoreceptor drums 231Y, 231C, 231M, and 231K, respectively, from which the toner images have been primarily transferred onto a transfer medium. The cleaners 236Y, 236C, 236M, and 236K remove residual toner particles remaining on the surfaces of the photoreceptor drums 231Y, 231C, 231M, and 231K, respectively, without being transferred onto the transfer medium.

Hereinafter, any one of the photoreceptor drums 231Y, 231C, 231M, and 231K may be simply referred to as the "photoreceptor drum 231". Hereinafter, any one of the chargers 232Y, 232C, 232M, and 232K may be simply referred to as the "charger 232". Hereinafter, any one of the toner cartridges 234Y, 234C, 234M, and 234K may be simply referred to as the "toner cartridge 234". Hereinafter, any one of the developing units 10Y, 10C, 10M, and 10K may be simply referred to as the "developing unit 10". Hereinafter, any one of the neutralizers 235Y, 235C, 235M, and 235K may be simply referred to as the "neutralizer 235". Hereinafter, any one of the cleaners 236Y, 236C, 236M, and 236K may be simply referred to as the "cleaner 236".

The irradiator 233 irradiates the photoreceptor drums 231Y, 231C, 231M, and 231K with laser light L that is emitted from a light source 233*a* based on image information and reflected by polygon mirrors 233*b*Y, 233*b*C, 233*b*M, and 233*b*K that are driven to rotate by motors. Thus, an electrostatic latent image is formed on the photoreceptor drum 231 based on the image information.

The transfer part 240 includes a driving roller 241, a driven roller 242, an intermediate transfer belt 243, primary transfer rollers 244Y, 244C, 244M, and 244K, a secondary facing roller 245, and a secondary transfer roller 246. The intermediate transfer belt 243 is stretched across the driving roller 241 and the driven roller 242 and is rotatable counterclockwise in FIG. 1 as the driving roller 241 drives. The primary transfer rollers 244Y, 244C, 244M, and 244K are disposed facing respective photoreceptor drum 231 with the intermediate transfer belt 243 therebetween. The secondary facing roller 245 faces the secondary transfer roller 246 with the intermediate transfer belt 243 therebetween at a position where a toner image is transferred onto a sheet of paper. Hereinafter, any one of the primary transfer rollers 244Y, 244C, 244M, and 244K may be simply referred to as the "primary transfer roller 244".

In the transfer part 240, the primary transfer roller 244 is supplied with a primary transfer bias and a toner image formed on the photoreceptor drum 231 is primarily transferred onto the intermediate transfer belt 243. The secondary transfer roller 246 is then supplied with a secondary transfer bias and the toner image on the intermediate transfer belt 243 is secondarily transferred onto the sheet of paper sandwiched between the secondary transfer roller 246 and the secondary facing roller 245.

The fixing part 250 includes a heating roller 251 and a pressing roller 252. The heating roller 251 contains a heater and heats a sheet of paper to a temperature above the minimum fixable temperature of a toner in use. The pressing roller 252 rotatably presses against the heating roller 251 to form a contact surface (hereinafter "nip portion") therebetween. The minimum fixable temperature is a minimum temperature at which a toner is fixable on a sheet of paper.

The control part 500 includes a central processing unit (hereinafter "CPU"), a read only memory (hereinafter "ROM"), and a random access memory (hereinafter "RAM"), and controls operation of the entire image forming apparatus 1. The operation panel 510 doubles as a display panel that displays operational aspect of the image forming apparatus 1 and an operation panel that receives input from users.

Figure 2:
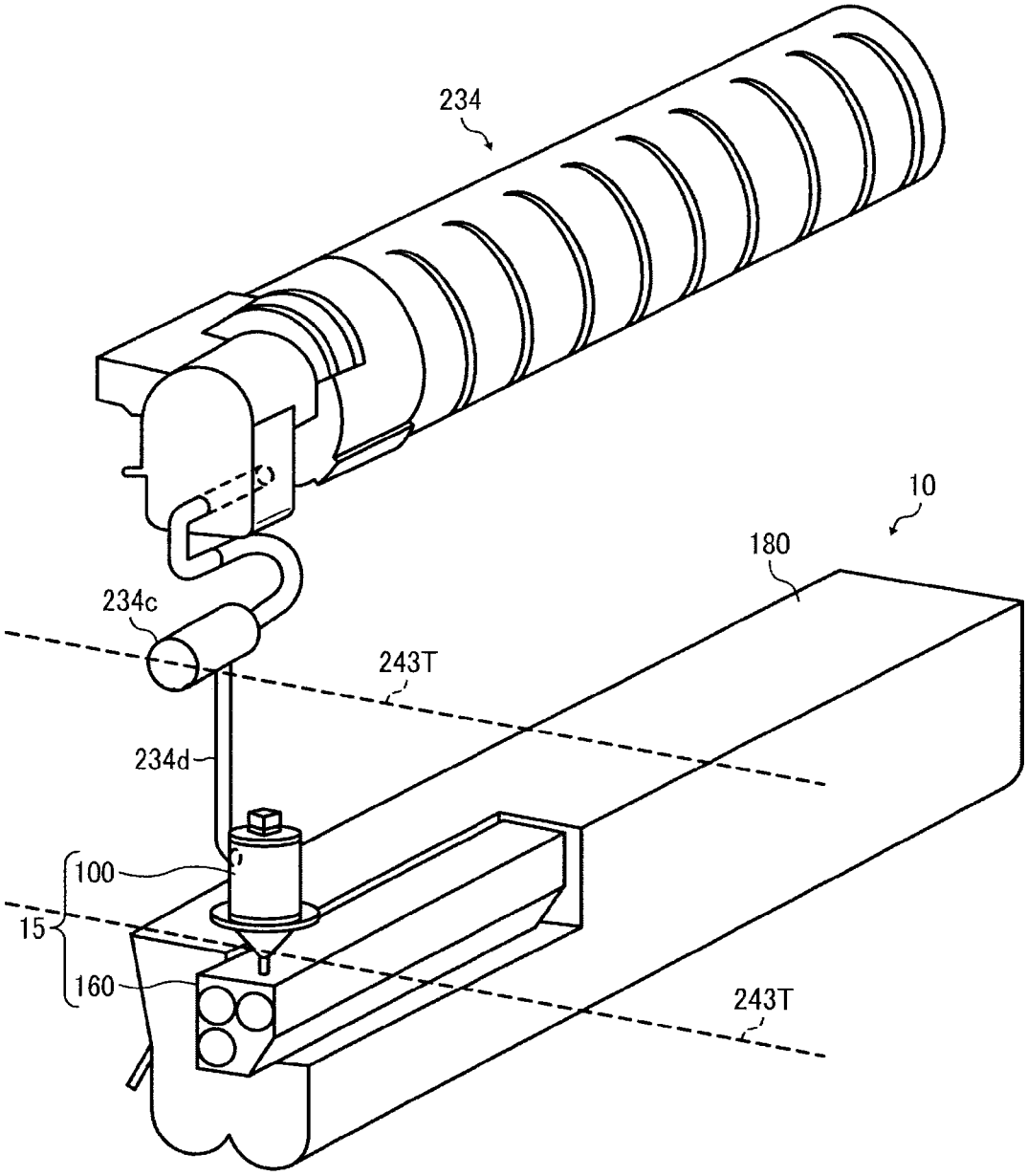
FIG. 2 is a perspective view of a developing unit and a toner cartridge according to an embodiment.

FIG. 2 is a perspective view of the developing unit 10 and the toner cartridge 234.

The developing unit 10 includes a supply unit 15 and a developing device 180. The supply unit 15 supplies toner particles to the developing device 180. The developing device 180 develops an electrostatic latent image formed on the photoreceptor drum 231 with the toner particles supplied from the supply unit 15. The supply unit 15 includes a sieve device 100 and a sub hopper 160. The sieve device 100 sieves the toner particles supplied from the toner cartridge 234 to remove coarse toner particles therefrom. The sub hopper 160 supplies the toner particles passed through the sieve device 100 to the developing device 180. Dotted lines illustrated in FIG. 2 represent edges 243T of the intermediate transfer belt 243.

Toner particles stored in the toner cartridge 234 are sucked by a suction pump 234*c* and supplied to the sieve device 100 through a supply pipe 234*d*.

Figure 3:
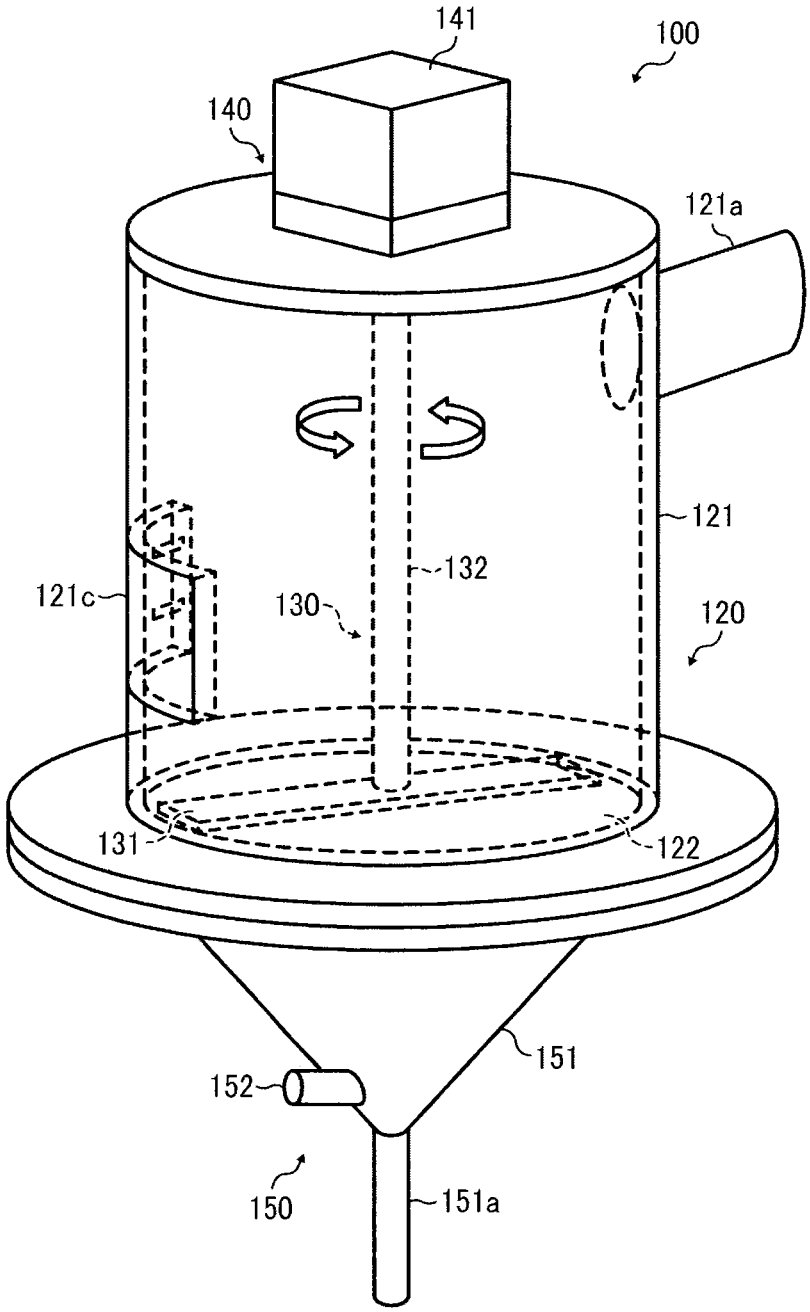
FIG. 3 is a perspective view of a sieve device according to an embodiment.
Figure 4:
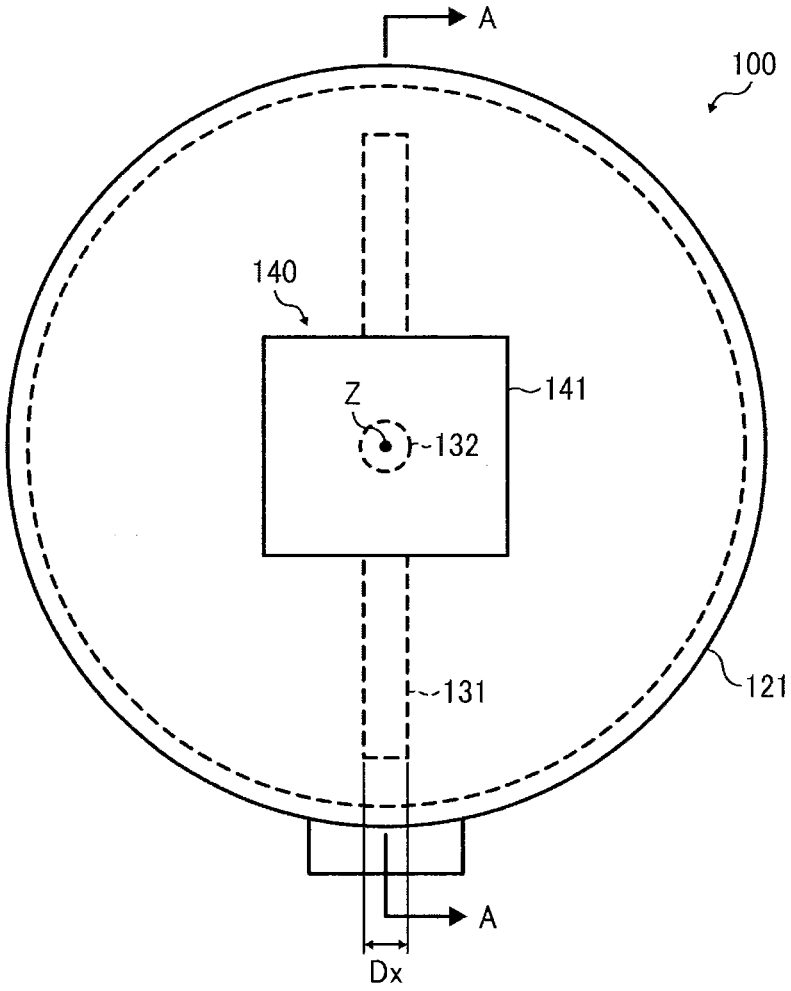
FIG. 4 is a plan view of the sieve device illustrated in FIG. 3.
Figure 5:
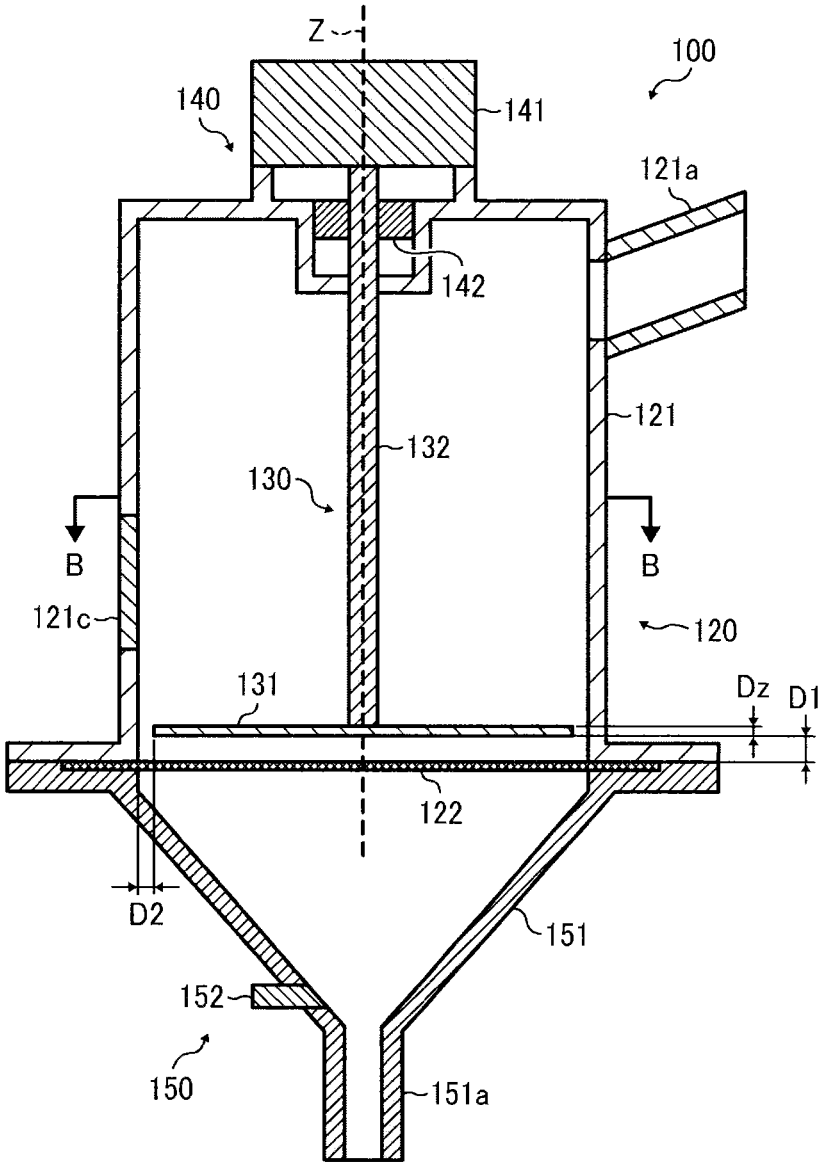
FIG. 5 is a cross-sectional view taken along a line A-A in FIG. 4.
Figure 6:
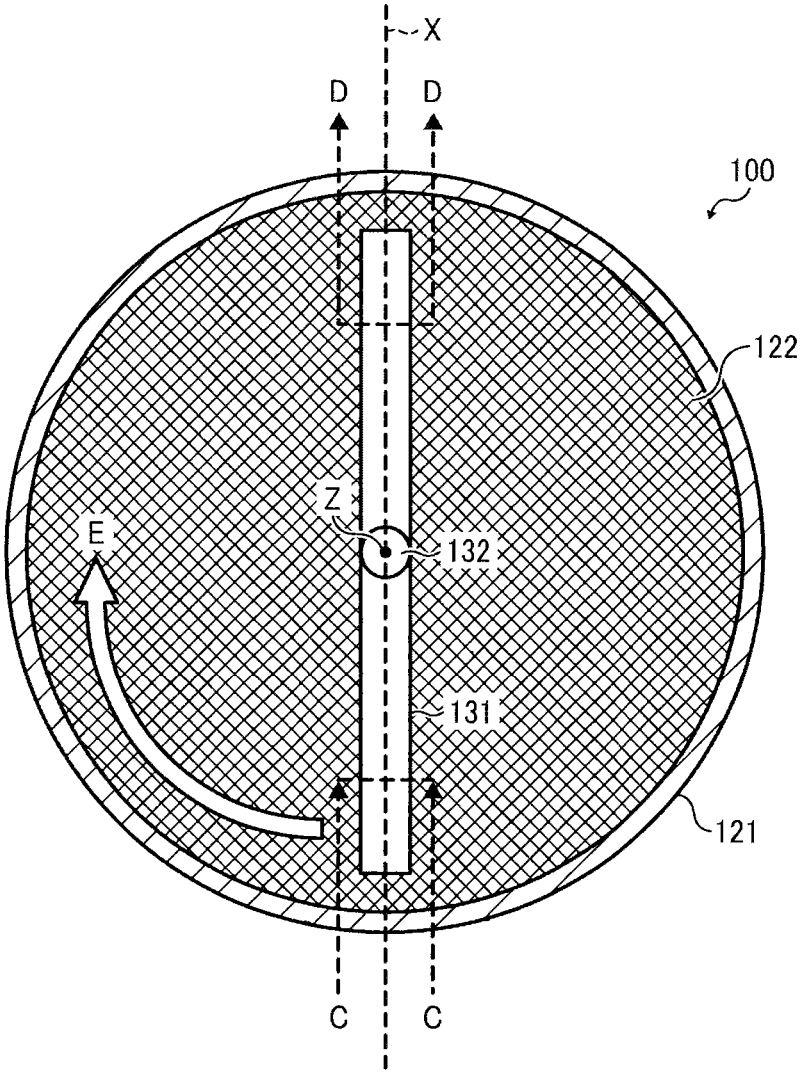
FIG. 6 is a cross-sectional view taken along a line B-B in FIG. 5.
Figure 7A:
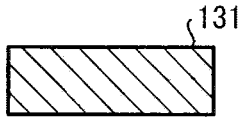
FIGS. 7A to 7J are cross-sectional views taken along a line C-C in FIG. 6.
Figure 7B:
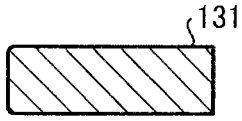
Figure 7C:
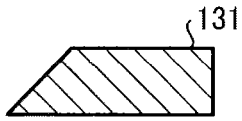
Figure 7D:
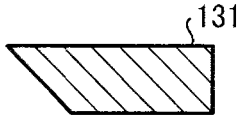
Figure 7E:
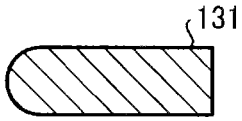
Figure 7F:
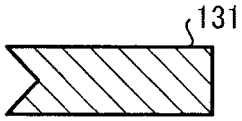
Figure 7G:
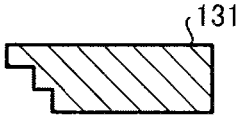
Figure 7H:
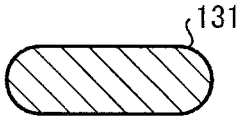
Figure 7I:
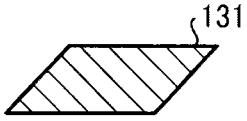
Figure 7J:
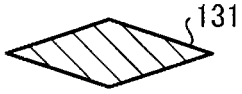
Figure 8A:
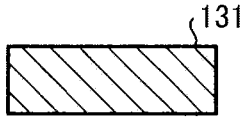
FIGS. 8A to 8J are cross-sectional views taken along a line D-D in FIG. 6.
Figure 8B:
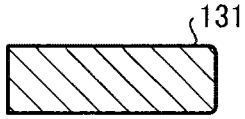
Figure 8C:
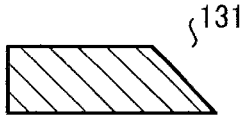
Figure 8D:
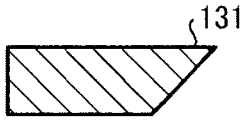
Figure 8E:
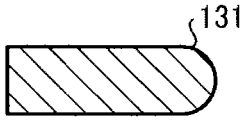
Figure 8F:
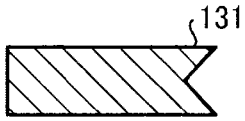
Figure 8G:
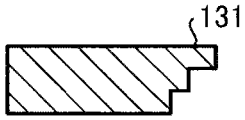
Figure 8H:
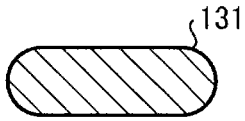
Figure 8I:
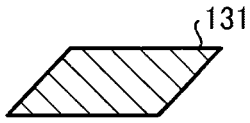
Figure 8J:
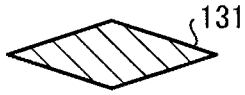
Figure 9:
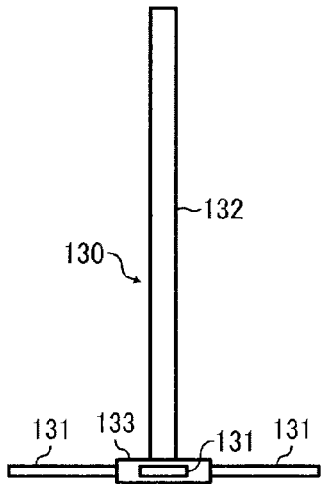
FIG. 9 is a front view of a rotator having three blades.
Figure 10:
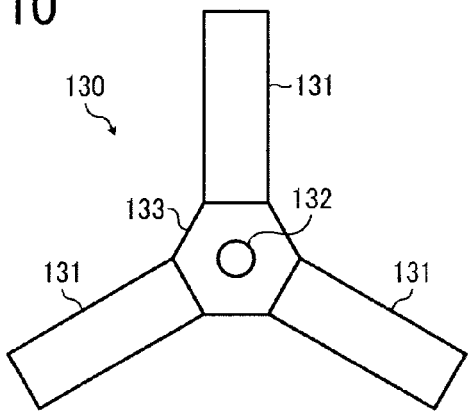
FIG. 10 is a plan view of the rotator illustrated in FIG. 9.
Figure 11:
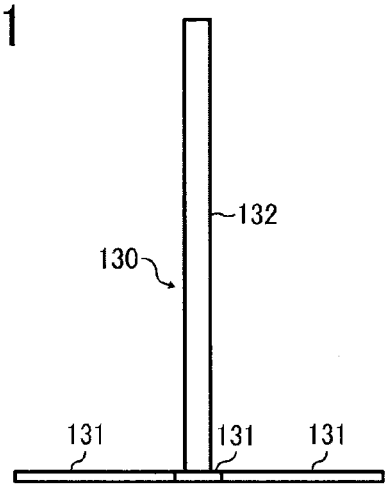
FIG. 11 is a front view of a rotator having four blades.
Figure 12:
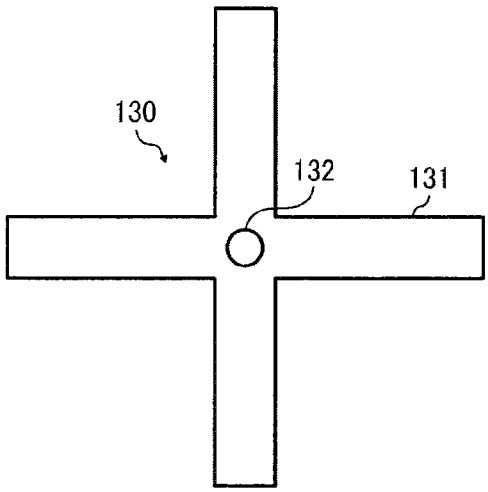
FIG. 12 is a plan view of the rotator illustrated in FIG. 11.

The sieve device 100 is described in detail below with reference to the following drawings FIG. 3 to FIG. 12. FIG. 3 is a perspective view of the sieve device 100. FIG. 4 is a plan view of the sieve device 100. FIG. 5 is a cross-sectional view taken along a line A-A in FIG. 4. FIG. 6 is a cross-sectional view taken along a line B-B in FIG. 5. FIGS. 7A to 7J are cross-sectional views taken along a line C-C in FIG. 6. FIGS. 8A to 8J are cross-sectional views taken along a line D-D in FIG. 6. FIG. 9 is a front view of a rotator having three blades. FIG. 10 is a plan view of the rotator illustrated in FIG. 9. FIG. 11 is a front view of a rotator having four blades. FIG. 12 is a plan view of the rotator illustrated in FIG. 11. The sieve device 100 includes a sieve body 120 and a supply part 150.

The sieve body 120 includes a frame 121 that is cylindrical, a filter 122 disposed at the bottom of the frame 121, a rotator 130, and a drive part 140. The sieve body 120 has a function of containing toner particles supplied to the frame 121. The sieve body 120 also has a function of sieving toner particles supplied to the frame 121 to remove coarse toner particles therefrom. The sieve body 120 is set either vertically or aslant.

The frame 121 may be in the form of, for example, a cylinder, a circular truncated cone, a rectangular cylinder, a truncated pyramid, or a hopper. The size of the frame 121 is determined in consideration of the supply speed of toner particles to the developing device 180 and its installation space in the developing unit 10. In some embodiments, the inner diameter of the frame 121 is within a range of 10 to 300 mm, or 16 to 135 mm. The frame 121 may be comprised of, for example, metals (e.g., stainless steel, aluminum, iron) or resins (e.g., ABS, FRP, polyester resin, polypropylene resin). The frame 121 may be comprised of either single material or multiple materials.

A supply part 121*a* is disposed to at least one of the side, bottom, and upper surfaces of the frame 121. The supply part 121*a* is connectable to the supply pipe 234*d*. The supply part 121*a* is not limited in size, shape, and configuration so long as toner particles can be supplied to the sieve body 120.

A cleaning door 121*c* is further disposed to the frame 121. The cleaning door 121*c* is opened to define an aperture for collecting toner particles from the sieve body 120. The cleaning door 121*c* is openable and closable on hinge relative to the sieve body 120. While the sieve device 100 is not operating, the cleaning door 121*c* is opened to define the aperture and coarse toner particles remaining on the filter 122 are removed through the aperture.

The filter 122 is not limited in its configuration so long as coarse toner particles can be removed from toner particles supplied to the sieve body 120. The filter 122 may be in the form of, for example, an orthogonal-pattern mesh, an oblique-pattern mesh, a meandering-pattern mesh, a hexagonal-pattern mesh, a piece of non-woven fabric that contains three-dimensional spaces, or a porous material or hallow fiber that does not allow passage of coarse toner particles. The filter 122 in the form of any mesh is advantageous in terms of sieving efficiency.

The filter 122 is not limited in its external form. For example, the filter 122 may be in the external form of a circle, an ellipse, a triangle, a quadrangle, a pentagon, a hexagon, or an octagon. The filter 122 in the external form of a circle is advantageous in terms of sieving efficiency. According to some embodiments, the filter 122 may be replaced with a multistage filter unit comprised of tandemly-arranged multiple filters each having different sieve openings.

In some embodiments, the filter 122 has a sieve opening within a range of 10 μm or more, 15 μm or more, or 20 μm or more. When the sieve opening is too small, sieving efficiency is poor and the filter 122 is likely to be clogged. Here, the sieve opening refers to the size of each aperture of the filter 122. When each aperture is in the form of a circle, the sieve opening represents the diameter of the circle. When each aperture is in the form of a polygon, the sieve opening represents the diameter of the inscribed circle of the polygon. In some embodiments, the filter 122 has a sieve opening not greater than 5 mm. When the sieve opening is greater than 5 mm, toner particles may be kept continuously discharged even when a blade 131 stops rotating because toner particles cannot bridge such large apertures.

The filter 122 may be comprised of, for example, metals (e.g., stainless steel, aluminum, iron), resins (e.g., polyamide resin such as nylon, polyester resin, polypropylene resin, acrylic resin), or natural fibers (e.g., cotton cloth). Stainless steel and polyester resin are advantageous in terms of durability.

Generally, an ultrasonic sieve equipped with a resin filter has a drawback that the resin filter cannot efficiently transmit vibration to toner particles due to its elasticity. A sieve device equipped with a cylindrical sieve generally has a mechanism of feeding powder from inside to outside of the sieve by centrifugal force. In this case, when the sieve is made of a resin, durability is insufficient. On the other hand, the sieve device 100 sieves toner particles by rotating a blade 131 without vibrating the filter 122. Therefore, the filter 122 in the sieve device 100 can be made of a resin. When the filter 122 is made of a resin having the same polarity to toner particles, the toner particles are prevented from adhering to the filter 122.

The filter 122 may be supported with a mechanism of keeping the shape thereof, such as a frame, so as not to crinkle or sag. If the filter 122 is crinkling or sagging, it is likely that the filter 122 gets damaged or does not perform uniform sieving.

In some embodiments, the filter 122 is slidable in a radial direction of the frame 121 so as to be detachably attachable to the frame 121. In such embodiments, maintenance of the sieve device 100 is much easier because the filter 122 is easily replaceable.

The rotator 130 includes the blade 131 and a shaft 132. The blade 131 is rotatable about a rotation axis Z that intersects with the filter 122 in proximity to the filter 122. The shaft 132 is coincident with the rotation axis Z. The blade 131 is attached to the shaft 132. Referring to FIG. 6, the blade 131 is rotatable about the shaft 132 in a direction indicated by an arrow E or the opposite direction above the filter 122. The blade 131 agitates and fluidizes toner particles supplied to the sieve body 120.

The rotator 130 is not limited in its configuration so long as the blade 131 is rotatable about the rotation axis Z in proximity to the filter 122. In accordance with some embodiments, the blade 131 is rotated by magnetic force without using the shaft 132. In accordance with some embodiments, the blade 131 is rotated in cooperation with the shaft 132 and a hub. The angle between the rotation axis Z and the filter 122 is not limited to a specific value. According to some embodiments, the angle is 90 degree. In such embodiments, the distance between the filter 122 and the blade 131 can be kept constant and they are prevented from contacting each other.

In this specification, the blade 131 being in proximity to the filter 122 refers to a state in which the blade 131 is so close to the filter 122 that a vortex generated by rotation of the blade 131 reaches the filter 122. It is to be noted that a state in which the blade 131 is in contact with the filter 122 over the entire rotational orbit is excluded. Referring to FIG. 5, a distance D1 is defined as a length of a line segment between one point on a filter-122-facing surface of the blade 131 and another point on a blade-131-facing surface of the filter 122 which is in parallel with the rotation axis Z. In some embodiments, the distance D1 is within a range greater than 0 mm and not greater than 5 mm, a range within 0.01 to 5 mm, or a range within 0.5 to 2 mm. In a case in which the length of the line segment varies depending on the measuring position on the rotational orbit of the blade 131, the distance D1 represents the minimum length among the lengths measurable at all possible measuring position on the rotational orbit. When the distance D1 exceeds 5 mm, a vortex generated by rotation of the blade 131 does not reach the filter 122 and the filter 122 is not cleaned. Additionally, toner particles accumulated on the filter 122 are not sufficiently fluidized. When the distance D1 is 0 mm, toner particles accumulated on the filter 122 below the blade 131 are prevented from moving upward and not sufficiently fluidized.

In accordance with some embodiments, an end part of the blade 131 is in proximity to the frame 121. Referring to FIG. 5, a distance D2 is defined as a length of a line segment between one point on the end surface of the blade 131 and another point on the inner surface of the frame 121 which is perpendicular to the rotation axis Z. In this specification, the end part of the blade 131 being in proximity to the frame 121 refers to a state in which the distance D2 is not greater than 5.0 mm. In some embodiments, D2 is not greater than 2.0 mm, or within a range of 0.5 to 1.5 mm. In a case in which the length of the line segment varies depending on the measuring position on the rotational orbit of the blade 131, the distance D2 represents the minimum length among the lengths measurable at all possible measuring position on the rotational orbit. When the distance D2 exceeds 5.0 mm, toner particles are likely to move toward the frame 121 due to centrifugal force generated by rotation of the blade 131. Such toner particles being away from the blade 131 may be difficult to be discharged from the frame 121 because of being out of reach of an effect of the vortex.

The sieve device 100 sieves toner particles by rotating the blade 131 without vibrating the filter 122. Therefore, in the sieve device 100, no vibration is transmitted from the filter 122 to the developing device 180. The sieve device 100 can be installed in the developing unit 10 with a high level of reliability.

The blade 131 is not limited in material, configuration, size, and shape. The blade 131 may be comprised of, for example, metals (e.g., stainless steel, aluminum, iron) or resins (e.g., ABS, FRP, polyester resin, polypropylene resin). Metals are advantageous in terms of strength. Resins capable of containing an antistatic agent are advantageous in terms of explosion proof. The blade 131 may be comprised of either single material or multiple materials.

The blade 131 may be in the form of, for example, a flat plate, a bar, a rectangular cylinder, a truncated pyramid, a cylinder, a circular truncated cone, or a blade. Referring to FIG. 5, a thickness Dz of the blade 131 is defined as a length of a line segment between one point on the upper surface of the blade 131 and another point on the opposite lower surface of the blade 131 which is in parallel with the rotation axis Z. The blade 131 may be installed in the sieve device 100 in a manner such that the thickness Dz gets as small as possible, for the purpose of securing strength of the blade 131. In a case in which the length of the line segment varies depending on the measuring position, the thickness Dz represents the minimum length among the lengths measurable at all possible measuring position. In some embodiments, the thickness Dz is within a range of 0 to 10.0 mm, 0 to 5.0 mm, or 0 to 3.0 mm. When the thickness Dz exceeds 5.0 mm, the amount of vortex generated by rotation of the blade 131 decreases and the filter 122 is not sufficiently cleaned. When the thickness Dz exceeds 10.0 mm, the blade 131 emits too much energy in its rotational direction rather than in a direction parallel to the rotation axis Z that is coincident with a direction of toner particles passing through the filter 122. As a result, toner particles are prevented from passing through the filter 122. Additionally, an extra load is put on a blade drive motor 141 and the blade drive motor 141 requires a larger amount of energy to drive the rotator 130.

According to an embodiment, the thickness Dz of the blade 131 is smaller than a length Dx (shown in FIG. 4) of the blade 131 in a tangential direction of rotation of the blade 131. Referring to FIG. 4, a length Dx is defined as a length of a line segment between one point on one longitudinal side surface of the blade 131 and another point on the opposite longitudinal side surface of the blade 131 which is in parallel with a tangential direction of rotation of the blade 131. In a case in which the length of the line segment varies depending on the measuring position, the length Dx represents the minimum length among the lengths measurable at all possible measuring position. When the thickness Dz is greater than the length Dx, the blade 131 rotates with continuous resistance from toner particles, resulting in deterioration of strength. Additionally, the blade 131 is too much accelerated in its rotational direction and toner particles are prevented from passing through the filter 122.

The blade 131 is not limited in its cross-sectional shape. The cross-sectional shape of the blade 131 taken along a line C-C in FIG. 6 may be either an asymmetric shape as illustrated in any of FIGS. 7B to 7G and 7I or a symmetric shape as illustrated in any of FIGS. 7A, 7H, and 7J. The cross-sectional shape of the blade 131 taken along a line D-D in FIG. 6 may be either an asymmetric shape as illustrated in any of FIGS. 8B to 8G and 8I or a symmetric shape as illustrated in any of FIGS. 8A, 8H, and 8J. The blade 131 may have any combination of the cross-sectional shape illustrated in any of FIGS. 7A to 7J, taken along the line C-C, with the cross-sectional shape illustrated in any of FIGS. 8A to 8J, taken along the line D-D.

In some embodiments, multiple blades 131 are arranged on the same plane. The number of the blades 131 is not limited to a specific value. According to an embodiment, the number of the blades 131 is two, as illustrated in FIGS. 3 to 6. According to another embodiment, the number of the blades 131 is three, as illustrated in FIGS. 9 and 10. According to another embodiment, the number of the blades 131 is four, as illustrated in FIGS. 11 and 12. In the embodiment illustrated in FIGS. 9 and 10, the blades 131 are fixed to the shaft 132 with a hub 133. In some embodiments, the number of the blades 131 is within a range of 1 to 8, or 1 to 4, or 2. When the number of the blades 131 exceeds 8, the blades 131 may undesirably prevent toner particles from passing through the filter 122. Also, maintenance of the blades 131 may get complicated.

In some embodiments, the angle of the blade 131 relative to the filter 122 in a direction of an axis X illustrated in FIG. 6 is within a range of −3 to 10 degrees, 0 to 10 degrees, or 0 degree (i.e., horizontal). When the angle exceeds 10 degrees, the amount of vortex generated behind the blade 131 decreases and the filter 122 is not sufficiently cleaned. Moreover, the blade 131 emits too much energy in its rotational direction. As a result, toner particles are prevented from passing through the filter 122. Additionally, an extra load is put on a blade driving motor 140.

According to some embodiments, the ratio ((X/Y)×100) of an area X defined by the rotation trajectory of the blade 131 to an area Y of the filter 122 is within a range of 60 to 150%, or 80 to 100%. When the ratio is less than 60%, the blade 131 cannot emit rotational energy over the whole surface of the filter 122. Moreover, toner particles are likely to move toward the frame 121 due to centrifugal force generated by rotation of the blade 131. The blade 131 may not give energy to those toner particles being away from the blade 131. When the ratio exceeds 150%, toner particles are likely to move toward the frame 121 due to centrifugal force generated by rotation of the blade 131 without being sieved with the filter 122.

According to some embodiments, the blade 131 rotates at a circumferential speed within a range of 3 to 30 m/s. When the blade 131 rotates at a circumferential speed less than 3 m/s, the blade 131 gives too small an amount of energy to toner particles, resulting in insufficient cleaning and fluidization of toner particles. When the blade 131 rotates at a circumferential speed above 30 m/s, the blade 131 gives too large an amount of energy to toner particles in a circumferential direction while preventing the toner particles from passing through the filter 122. In a case in which toner particles are excessively fluidized, the amount of toner particles allowed to pass through the filter 122 may decrease.

The shaft 132 is disposed coincident with the rotation axis Z within the sieve body 120. One end of the shaft 132 is attached to the drive part 140 and the other end is attached to the blade 131. The blade 131 and the shaft 132 rotate about the rotation axis Z as the drive part 140 drives. The shaft 132 is not limited in size, shape, configuration, and material. The shaft 132 may be comprised of, for example, metals (e.g., stainless steel, aluminum, iron) or resins (e.g., ABS, FRP, polyester resin, polypropylene resin). The shaft 132 may be comprised of either single material or multiple materials. The shaft 132 may be in the form of, for example, a bar or a rectangular cylinder.

The drive part 140 includes the blade drive motor 141 and a bearing 142. The blade drive motor 141 drives the rotator 130 and the blade 131 to rotate. Operation of the blade drive motor 141 is controlled by a controller such as a PLC (programmable logic controller) or a computer. The bearing 142 supports the shaft 132 so that the rotator 130 rotates in a precise manner. The bearing 142 is disposed outside the frame 121 so that toner particles do not get inside and damage the drive part 140. In a case in which toner particles possibly get inside the drive part 140 through a gap between the shaft 132 and the frame 121, a mechanism for preventing toner particles from getting inside the drive part 140 may be provided. As an example, a mechanism for blowing air into a gap between the bearing 142 and the frame 121 and blowing it out from a gap between the shaft 132 and the frame 121 (i.e., air shield); or an air outlet may be provided.

The drive part 140 may further include a braking mechanism that causes the rotator 130 to stop rotation when the apparatus stops operation. As the braking mechanism causes the blade 131 to stop rotation when the apparatus stops operation, fluidization of toner particles calms down quickly. As a result, the degree of precision of feeding toner particles from the sieve device 100 to the developing device 180 is improved.

Because the sieve device 100 needs not vibrating the filter 122 with ultrasonic waves or vibrational waves, the apertures of the filter 122 are prevented from being clogged with deteriorated toner particles which are softened or aggregated by frictional heat or being undesirably enlarged by frictional stress.

The supply part 150 includes a nozzle 151 serving as an introduction unit and a toner sensor 152. The nozzle 151 is connectable to the sub hopper 160. When being connected to the sub hopper 160, the nozzle 151 introduces toner particles passed through the filter 122 into the sub hopper 160. The nozzle 151 is not limited in its configuration so long as toner particles can be introduced into the developing device 180. For example, the nozzle 151 may be comprised of a stainless steel tube. The nozzle 151 has a fit part 151*a* fittable into a toner inlet disposed at an end part of the upper surface of the sub hopper 160. The fit part 151 a may be equipped with a packing for more precisely fitting the nozzle 151 into the toner inlet. In a case in which the toner inlet is relatively small, toner particles may be introduced into the sub hopper 160 via a funnel rather than directly from the fit part 151*a*.

The toner sensor 152 detects toner particles passed through the filter 122. The toner sensor 152 detects toner particles based on magnetic permeability transmittance.

Figure 13:
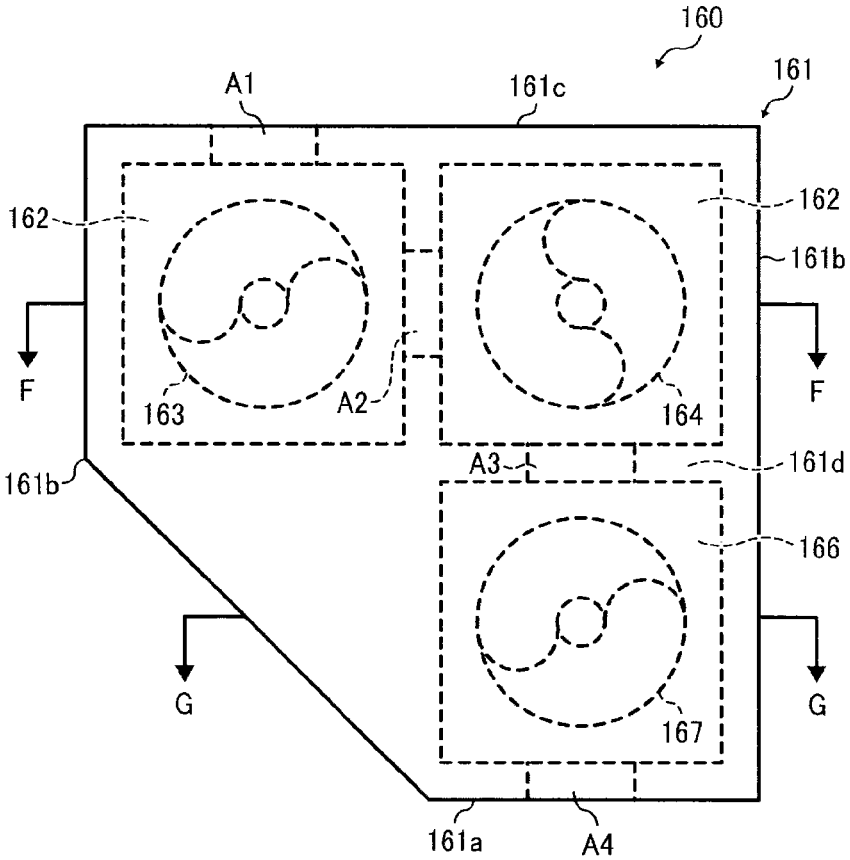
FIG. 13 is a front view of a sub hopper.
Figure 14:
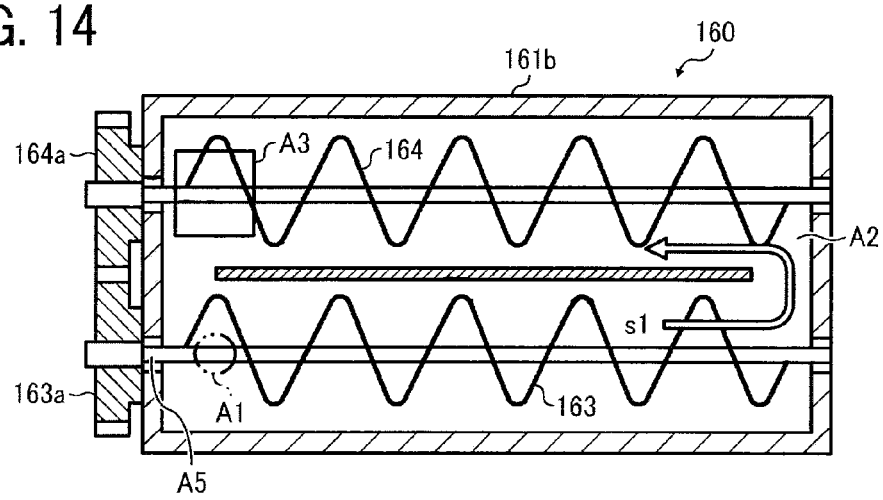
FIG. 14 is a cross-sectional view taken along a line F-F in FIG. 13.
Figure 15:
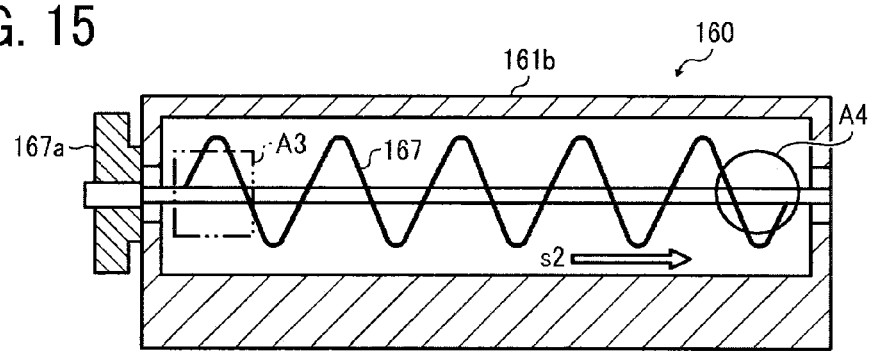
FIG. 15 is a cross-sectional view taken along a line G-G in FIG. 13.

The sub hopper 160 is described in detail below with reference to the following drawings FIG. 13 to FIG. 15. FIG. 13 is a front view of the sub hopper 160. FIG. 14 is a cross-sectional view taken along a line F-F in FIG. 13. FIG. 15 is a cross-sectional view taken along a line G-G in FIG. 13. The sub hopper 160 includes a sub hopper main body 161 including a bottom plate 161*a*, a sub hopper frame 161*b* that is a cylindrical body disposed to stand around the bottom plate 161*a*, and a top plate 161*c* disposed at an upper opening of the sub hopper frame 161*b*. The bottom plate 161*a* has a supply aperture A4 through which toner particles are supplied to the developing device 180. The top plate 161*c* has an inlet aperture A1 through which toner particles passed through the filter 122 by rotation of the blade 131 are introduced into the sub hopper 160. The sub hopper 160 further includes a first upper screw 163, a second upper screw 164 and a lower screw 167 that feed toner particles introduced from the inlet aperture A1 to the supply aperture A4. Here, the sub hopper frame 161*b* being disposed to stand around the bottom plate 161*a* refers to a state in which the sub hopper frame 161*b* is forming an angle greater than 0 degree and less than 180 degrees with the bottom plate 161*a*. Each of the first upper screw 163, second upper screw 164, and lower screw 167 is supported with both end surfaces of the sub hopper frame 161*b* in a longitudinal direction. The first upper screw 163, second upper screw 164, and lower screw 167 are rotated in conjunction with each other via gears 163*a*, 164*a*, and 167*a* as a driving motor drives.

The sub hopper 160 is divided into an upper chamber 162 and a lower chamber 166 by a divider 161*d*. The inlet aperture Al is disposed at the top plate 161*c* in proximity to and above a support part A5 supporting the first upper screw 163. Thus, the sieve device 100 is arranged on the support-part-A5-side above the sub hopper 160, and therefore it is possible to arrange the intermediate transfer belt 243 on the opposite side above the sub hopper 160 in a longitudinal direction. Toner particles introduced into the sub hopper 160 through the inlet aperture A1 are fed in a direction indicated by an arrow s1 in FIG. 14 as the first upper screw 163 and the second upper screw 164 rotate. The toner particles pass through a communication aperture A2 and then fall down to the lower chamber 166 through a communication aperture A3.

The toner particles fallen down from the upper chamber 162 to the lower chamber 166 through the communication aperture A3 are then fed in a direction indicated by an arrow s2 in FIG. 15 as the lower screw 167 rotates. The toner particles then fall down to the developing device 180 through the supply aperture A4.

Figure 16:
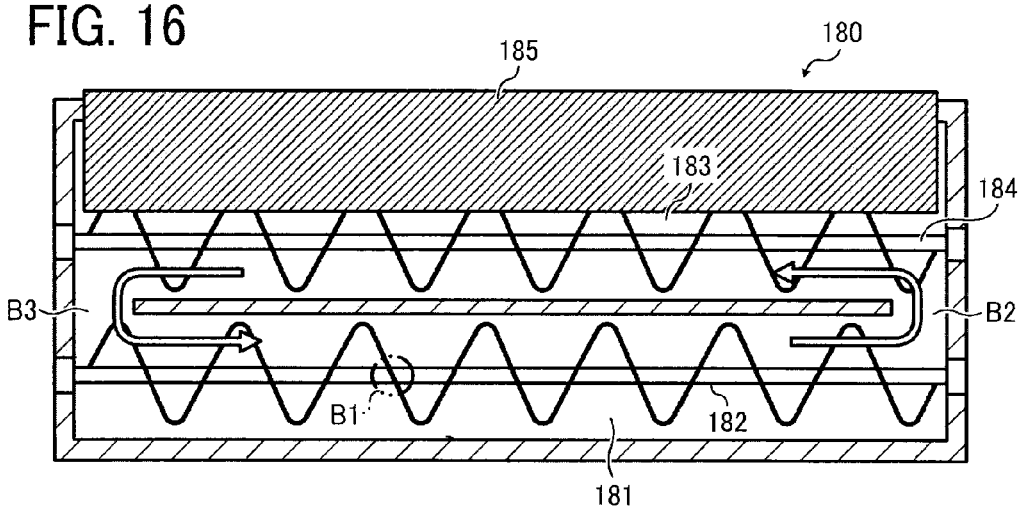
FIG. 16 is a cross-sectional view of a developing device in a transverse direction.
Figure 17:
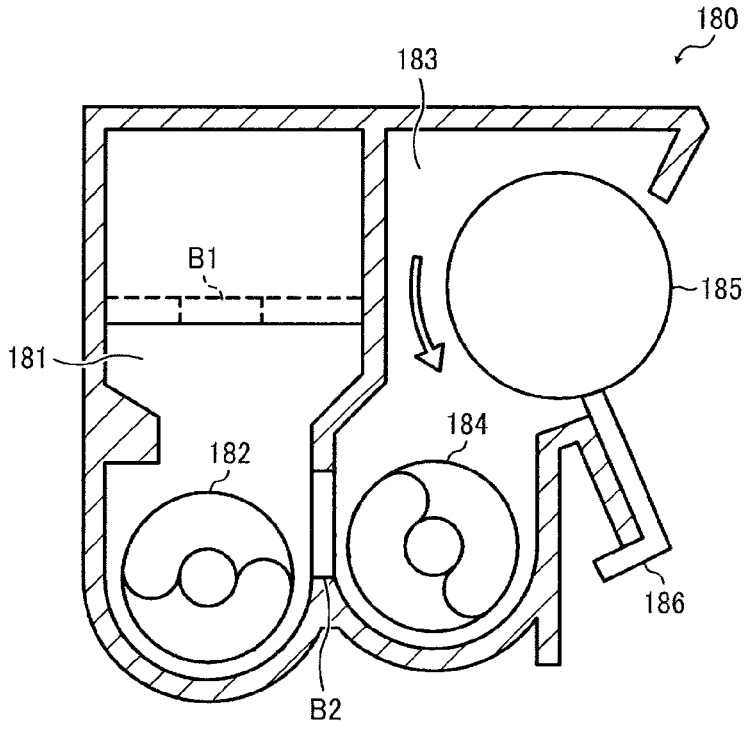
FIG. 17 is a cross-sectional view of the developing device illustrated in FIG. 16 in a longitudinal direction.

The developing device 180 is described in detail below with reference to the following drawings FIG. 16 and FIG. 17. FIG. 16 is a cross-sectional view of the developing device 180 in a transverse direction. FIG. 17 is a cross-sectional view of the developing device 180 in a longitudinal direction. The developing device 180 includes a first storage chamber 181, a first feed screw 182 disposed within the first storage chamber 181, a second storage chamber 183, a second feed screw 184 disposed within the second storage chamber 183, a developing roller 185, and a doctor blade 186. Each of the first storage chamber 181 and the second storage chamber 182 stores magnetic carrier particles.

A supply aperture B1 is disposed above the first feed screw 182 at a position shown in FIG. 16. The supply aperture B1 is connectable to the supply aperture A4 of the sub hopper 160. The first feed screw 182 is driven to rotate by a driving motor and feeds developer, comprised of toner particles supplied through the supply aperture B1 and the magnetic carrier particles, from a left side to a right side in FIG. 16. The developer then gets in the second storage chamber 183 through a communication aperture B2 disposed at a part of a divider dividing the first storage chamber 181 and the second storage chamber 183. The second feed screw 184 is driven to rotate by a driving motor and feeds the developer from a right side to a left side in FIG. 16.

The developing roller 185 contains a magnet roller. The developer is adsorbed to the developing roller 185 by the action of magnetic force of the magnet roller while being fed within the second storage chamber 183. The developer adsorbed to the developing roller 185 is carried to a position where the developing roller 185 is facing the doctor blade 186 as the developing roller 185 rotates in a direction indicated by arrow in FIG. 17. The doctor blade 186 regulates the thickness of the developer layer on the developing roller 185. Thereafter, the developer layer is carried to a position where the developing roller 185 is facing the photoreceptor drum 231. The developer transfers to an electrostatic latent image carried on the photoreceptor drum 231. Thus, a toner image is formed on the photoreceptor drum 231. The developer, from which toner particles have been consumed in the developing of the electrostatic latent image, is returned to the second storage chamber 183 as the developing roller 185 rotates. The developer is then fed within second storage chamber 183 from a right side to a left side in FIG. 16 by the second feed screw 184 and returned to the first storage chamber 181 through a communication aperture B3.

Figure 18:
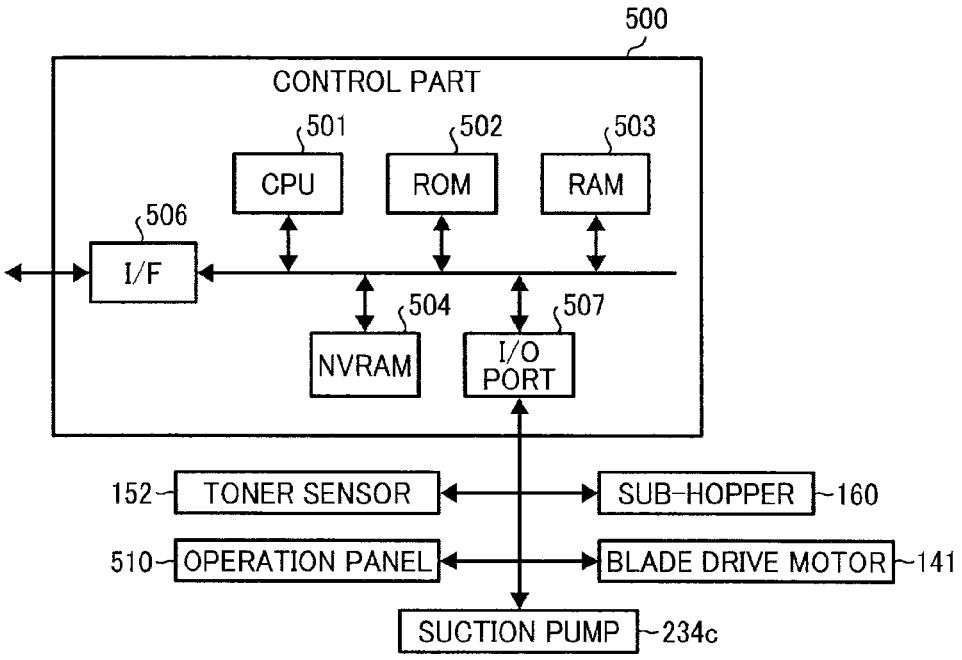
FIG. 18 is a hardware configuration diagram of a control part of the image forming apparatus illustrated in FIG. 1.
Figure 19:
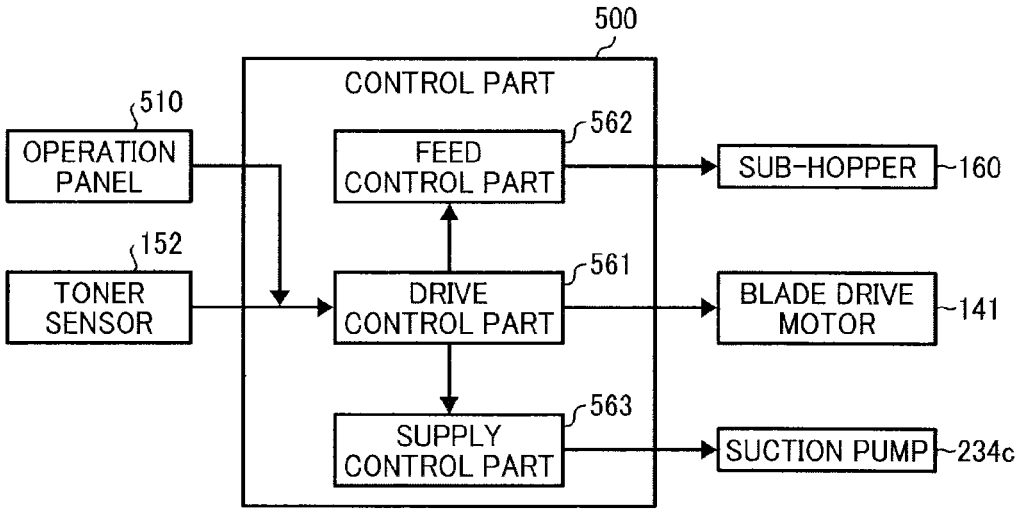
FIG. 19 is a functional block diagram of the control part illustrated in FIG. 18.

The control part 500 is described in detail below with reference to the following drawings FIG. 18 and FIG. 19. FIG. 18 is a hardware configuration diagram of the control part 500. FIG. 19 is a functional block diagram of the control part 500.

The hardware configuration of the control part 500 is described referring to FIG. 18. The control part 500 includes a CPU 501, a ROM 502, a RAM 503, a non-volatile memory (NVRAM) 504, an interface (I/F) 506, and an input/output (I/O) port 507. The CPU 501 controls operation of the entire image forming apparatus 1. The ROM 502 memorizes a program for operating the image forming apparatus 1. The RAM 503 is used as a work area of the CPU 501. The NVRAM 504 retains data while the image forming apparatus 1 is powered off. The I/F 506 transmits and receives information between a host computer and external devices. The I/O port 507 transmits and receives information among the blade drive motor 141, the sub hopper 160, the toner sensor 152, the suction pump 234*c*, and the operation panel 510.

The functional configuration of the control part 500 is described referring to FIG. 19. The control part 500 includes a drive control part 561, a feed control part 562, and a supply control part 563. These parts work when at least one of the constitutional elements illustrated in FIG. 18 performs operation by an instruction from the CPU 501 according to a program stored in the ROM 502.

The drive control part 561 controls rotary drive of the blade 131 by the blade drive motor 141 based on a result detected by the toner sensor 152. The feed control part 562 controls toner feed of the sub hopper 160. The supply control part 563 controls toner suction of the suction pump 234*c*.

Developer stored in the developing unit 10 is described below. The developer may be either a one-component developer including toner particles or a two-component developer including toner particles and magnetic carrier particles. The toner particles may have a color of yellow, cyan, magenta, or black. Alternatively, the toner particles may be colorless.

Usable toner particles are not limited in their production process. For example, usable toner particles can be prepared by wet processes. The wet processes here refer to processes of producing toner particles using an aqueous medium such as water. Specific wet processes are listed below.

(a) A suspension polymerization process in which a polymerizable monomer, a polymerization initiator, and a colorant are suspended in an aqueous medium to allow polymerization to occur.

(b) An emulsion polymerization aggregation process in which a polymerizable monomer is emulsified in an aqueous medium containing a polymerization initiator and an emulsifier under agitation to allow polymerization to occur, the resulting dispersion liquid of primary particles of the polymer is mixed with a colorant to cause aggregation, and the aggregated particles are aged.

(c) A dissolution suspension process in which toner constituents such as a polymer and a colorant are dissolved or dispersed in a solvent, the resulting solution or dispersion liquid is dispersed in an aqueous medium, and the solvent is removed by application of heat or reduction of pressure. The toner constituents may include, for example:

(1) a binder resin and a colorant;
(2) a binder resin, a colorant, and a charge controlling agent;
(3) a binder resin, a colorant, a charge controlling agent, and a wax; or
(4) a binder resin, a magnetic agent, a charge controlling agent, and a wax.

The binder resin is not limited to a specific resin. The binder resin may be, for example, a thermoplastic resin. Usable thermoplastic resins include, for example, vinyl resins, polyester resins, and polyol resins. Two or more kinds of these resins can be used in combination.

Specific examples of usable vinyl resins include, but are not limited to, homopolymers of styrene or derivatives thereof (e.g., polystyrene, poly-p-chlorostyrene, polyvinyl toluene), styrene-based copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl a-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, and polyvinyl acetate. Usable polyester resins may be prepared from diols (A group) and dibasic acids (B group), and optional alcohols and carboxylic acids having 3 or more valences (C group).

Specific examples of diols in the A group include, but are not limited to, ethylene glycol, triethylene glycol, 1,2-propylene glycol, 1,3-propylene glycol, 1,4-butanediol, neopentyl glycol, 1,4-butenediol, 1,4-bis(hydroxymethyl)cyclohexane, bisphenol A, hydrogenated bisphenol A, polyoxyethylenated bisphenol A, polyoxypropylene(2,2)-2,2'-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, and polyoxypropylene(2,0)-2,2'-bis(4-hydroxyphenyl)propane.

Specific examples of dibasic acids in the group B include, but are not limited to, maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, and linolenic acid; and acid anhydrides and lower alkyl esters of these acids.

Specific examples of alcohols and carboxylic acids in the group C include, but are not limited to, alcohols having 3 or more valences such as glycerin, trimethylolpropane, and pentaerythritol; and carboxylic acids having 3 or more valences such as trimellitic acid and pyromellitic acid.

Usable polyol resins may be prepared from a reaction between an epoxy resin and an alkylene oxide adduct of divalent phenol; a reaction between a glycidyl ether of an epoxy resin and a compound having one active hydrogen per molecule reactive with the epoxy resin; or a reaction between a glycidyl ether of an epoxy resin and a compound having two active hydrogens per molecule reactive with the epoxy resin.

Additionally, the following resins are used in combination with the above resins: epoxy resins, polyamide resins, urethane resins, phenol resins, butyral resins, rosin, modified rosin, and terpene resins. Specific examples of usable epoxy resins include, but are not limited to, polycondensation products between bisphenols (e.g., bisphenol A, bisphenol F) and epichlorohydrin.

Usable colorants are described below. Two or more kinds of the following colorants can be used in combination.

Specific examples of usable black colorants include, but are not limited to, azine dyes, metal salt azine dyes, metal oxides, and complex metal oxides, such as carbon black, oil furnace black, channel black, lamp black, acetylene black, and aniline black. Specific examples of usable yellow colorants include, but are not limited to, Cadmium Yellow, Mineral Fast Yellow, Nickel Titanium Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake. Specific examples of usable orange colorants include, but are not limited to, Molybdenum Orange, Permanent Orange GTR, Pyrazolone Orange, Vulcan Orange, Indanthrene Brilliant Orange RK, Benzidine Orange G, and Indanthrene Brilliant Orange GK. Specific examples of usable red colorants include, but are not limited to, colcothar, Cadmium Red, Permanent Red 4R, Lithol Red, Pyrazolone Red, Watching Red calcium salt, Lake Red D, Brilliant Carmine 6B, Eosin Lake, Rhodamine Lake B, Alizarin Lake, and Brilliant Carmine 3B. Specific examples of usable violet colorants include, but are not limited to, Fast Violet B and Methyl Violet Lake. Specific examples of usable blue colorants include, but are not limited to, Cobalt Blue, Alkali Blue, Victoria Blue Lake, Phthalocyanine Blue, metal-free Phthalocyanine Blue, partially-chlorinated Phthalocyanine Blue, Fast Sky Blue, and Indanthrene Blue BC. Specific examples of usable green colorants include, but are not limited to, Chrome Green, chromium oxide, Pigment Green B, and Malachite Green. In some embodiments, the content of the colorant is 0.1 to 50 parts by weight, or 5 to 20 parts by weight, based on 100 parts of the binder resin.

Waxes generally imparting releasability to toner. Usable waxes include, for example, synthetic waxes such as low-molecular-weight polyethylene and polypropylene; and natural waxes such as carnauba wax, rice wax, and lanolin. In some embodiments, the content of the wax in the toner is 1 to 20% by weight, or 3 to 10% by weight.

Specific examples of usable charge controlling agents include, but are not limited to, nigrosine, acetylacetone metal complexes, monoazo metal complexes, naphthoic acid, metal salts of fatty acids (e.g., metal salts of salicylic acid or derivatives of salicylic acid), triphenylmethane dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, and fluorine activators. Two or more of these materials can be used in combination. In some embodiments, the content of the charge controlling agent in the toner is 0.1 to 10% by weight, or 0.5 to 5% by weight.

The toner particles may further externally include inorganic particulate materials such as silica and titanium oxide to improve fluidity.

In some embodiments, the toner particles have a number average particle diameter within a range of 3.0 to 10.0 μm or 4.0 to 7.0 μm. In some embodiments, the ratio of the weight average particle diameter to the number average particle diameter of the toner particles is within a range of 1.03 to 1.5 or 1.06 to 1.2. The weight average particle diameter and number average particle diameter of toner particles can be measured by an instrument COULTER COUNTER MULTISIZER (from Beckman Coulter, Inc.).

Usable magnetic carrier is not limited in its material. For example, hematite, iron powder, magnetite, and ferrite are usable as the magnetic carrier. In some embodiments, the content of the magnetic carrier is 5 to 50% by weight, or 10 to 30% by weight, based on 100 parts by weight of the toner particles.

Figure 20:
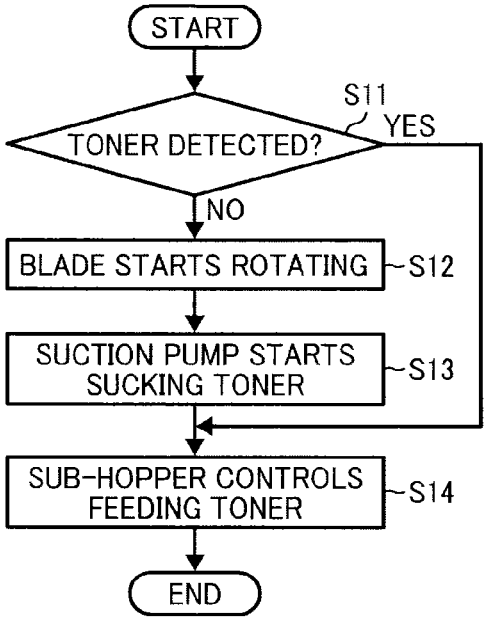
FIG. 20 is a processing flow chart of the image forming apparatus illustrated in FIG. 1.
Figure 21:
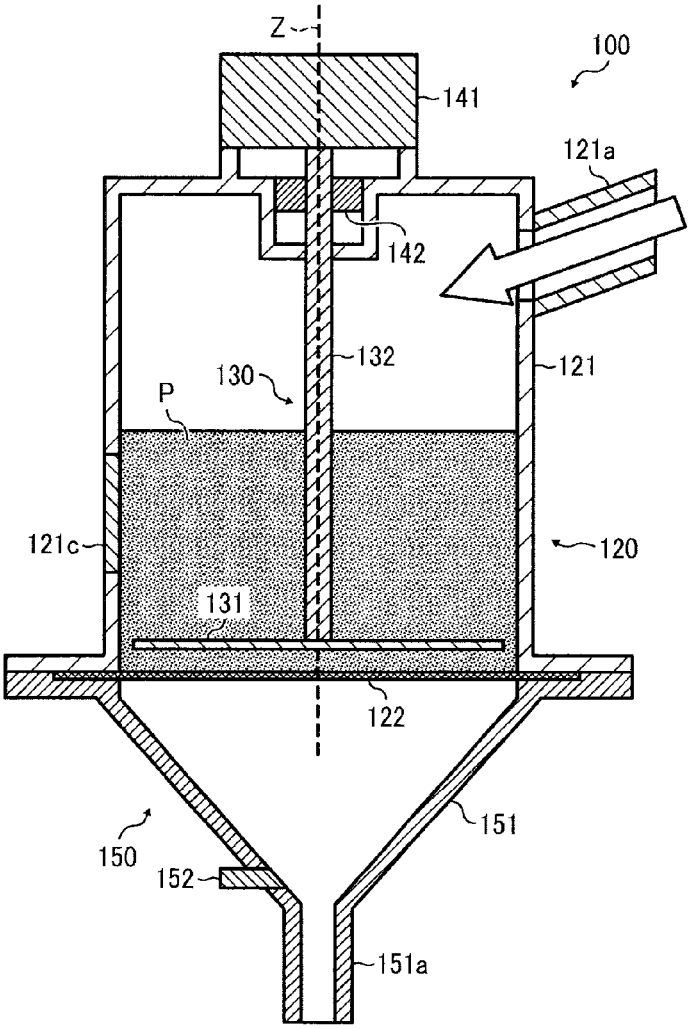
FIG. 21 is a schematic view of the sieve device illustrated in FIG. 3 supplied with toner particles.
Figure 22:
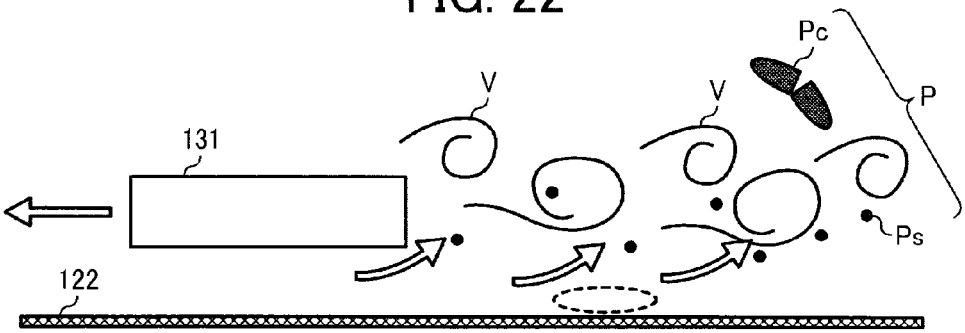
FIGS. 22 and 23 are schematic views of the sieve device illustrated in FIG. 3 in a toner sieving operation.
Figure 23:
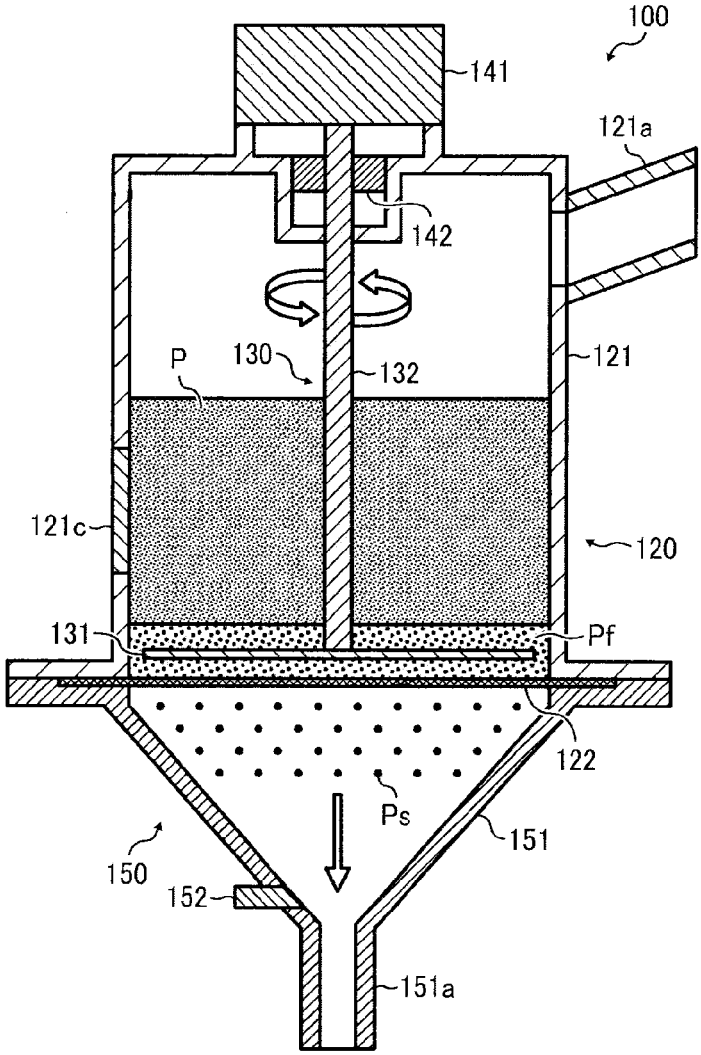

Operation and processing flow of the image forming apparatus 1 is described in detail below with reference to the following drawings FIG. 20 to FIG. 23. FIG. 20 is a processing flow chart of the image forming apparatus 1. FIG. 21 is a schematic view of the sieve device 100 illustrated in FIG. 3 supplied with toner particles. FIGS. 22 and 23 are schematic views of the sieve device 100 illustrated in FIG. 3 in a toner sieving operation.

Upon reception of a printing request by the operation panel 510 or the I/F 506, the drive control part 561 determines if the toner sensor 152 is detecting toner particles or not based on a signal transmitted from the toner sensor 152 ("step S11"). When drive control part 561 determines that the toner sensor 152 is detecting toner particles ("YES" in the step S11), the sieve device 100 does not start feeding toner particles to the sub hopper 160 because the sub hopper 160 is already filled with an adequate amount of toner particles.

When drive control part 561 determines that the toner sensor 152 is not detecting toner particles ("NO" in the step S11), the sieve device 100 starts feeding toner particles to the sub hopper 160 because the sub hopper 160 is in short supply of toner particles. The drive control part 561 outputs a signal for starting rotary drive of the blade 131 to the blade drive motor 141 ("step S12"). The blade drive motor 141 drives the rotator 130 to rotate based on the signal. Thus, the shaft 132 and the blade 131 attached to the end of the shaft 132 are rotated about the rotation axis Z in proximity to the filter 122. According to some embodiments, the rotational speed is within a range of 500 to 4,000 rpm. According to some embodiments, the blade 131 is allowed to rotate before the start of toner supply to the sieve device 100 from the toner cartridge 234 so that coarse toner particles having been remaining on the filter 122 since the previous operation get fluidized. As a result, the filter 122 is cleaned and the sieve device 100 starts performing an effective sieving operation at the start of toner supply.

Subsequently, the supply control part 563 transmits a signal for starting suction to the suction pump 234*c* ("step S13"). The suction pump 234*c* starts sucking toner particles from the toner cartridge 234 and supplies them to the sieve device 100 through the supply pipe 234*d*.

A certain amount of toner particles P is supplied from the toner cartridge 234 to the frame 121 of the sieve body 120 through the supply part 121*a* as illustrated in FIG. 21 (hereinafter a "supply process"). The toner particles P are accumulated on the filter 122 within the frame 121. When the ratio between the sieve opening of the filter 122 and the particle diameter of each of the toner particles P is equal to or less than a specific ratio, the toner particles, even those having a particle diameter smaller than the sieve opening, support each other to bridge the apertures and accumulate on the filter 122. The blade 131 rotates to agitate and fluidize the toner particles P accumulated on the filter 122 (hereinafter an "agitation process"). As illustrated in FIG. 22, the blade 131 moves in a certain direction with a certain speed relative to the toner particles P accumulated within the sieve body 120, thus generating vortexes V at its trailing-edge side. A vortex here refers to a flow of a fluid randomly or alternately generated at a trailing-edge side of a solid moving in a certain direction within the fluid.

Referring to FIG. 22, a coarse toner particle Pc is pulverized on contact with the blade 131 and swirled up by the vortexes V generated by rotation of the blade 131 (hereinafter a "filter cleaning process"). As a result of the filter cleaning process, a small toner particle Ps is allowed to pass through the filter 122 easily. In FIG. 23, a reference Pf represents toner particles which are fluidized by the action of the vortexes V. The fluidized toner particles Pf have a low bulk density because the air has been mixed therein. Therefore, when the fluidized toner particles Pf fall down by their own weight, small toner particles Ps are allowed to pass through the filter 122 with a high degree of efficiency and a low level of stress. After passing through the filter 122, the small toner particles Ps pass through the nozzle 151 to be introduced into the sub hopper 160.

When drive control part 561 determines that the toner sensor 152 is detecting toner particles ("YES" in the step S11) or when the suction pump 234*c* starts sucking in the step S13, the feed control part 562 controls toner feed of the sub hopper 160 ("step S14"). In particular, the feed control part 562 transmits signals for rotating the first upper screw 163, the second upper screw 164, and the lower screw 167 to the driving units thereof. Toner particles are supplied from the sub hopper 160 to the developing device 180 at a high degree of accuracy and the toner concentration in the developing device 180 is kept at a constant level.

The developing device 180 develops an electrostatic latent image formed on the photoreceptor drum 231 into a toner image with the toner particles supplied from the sub hopper 160 (hereinafter a "developing process"). In the transfer part 240, the primary transfer roller 244 is supplied with a primary transfer bias and the toner image formed on the photoreceptor drum 231 is primarily transferred onto the intermediate transfer belt 243. The secondary transfer roller 246 is then supplied with a secondary transfer bias and the toner image on the intermediate transfer belt 243 is secondarily transferred onto a sheet of paper sandwiched between the secondary transfer roller 246 and the secondary facing roller 245 (hereinafter a "transfer process"). The sheet of paper having the toner image thereon is heated to above the minimum fixable temperature by the heating roller 251 and pressurized by the pressing roller 252. Thus, the toner image is melted and fixed on the sheet of paper (hereafter a "fixing process").

Figure 24:
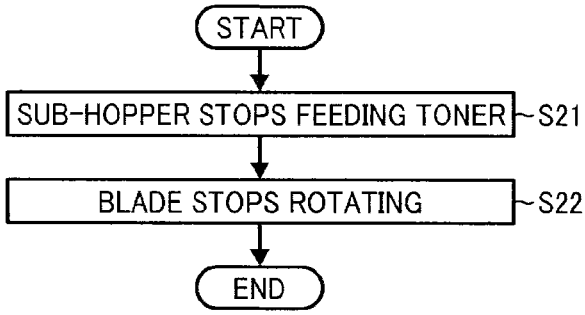
FIG. 24 is a processing flow chart of the image forming apparatus illustrated in FIG. 1.

Operation and processing flow of the image forming apparatus 1 at the end of printing is described in detail below with reference to the following drawings FIG. 24. FIG. 24 is a processing flow chart of the image forming apparatus 1.

Upon completion of the printing request received by the operation panel 510 or the I/F 506, the supply control part 563 transmits a signal for terminating toner suction from the toner cartridge 234 to the suction pump 234*c* ("step 21"). The suction pump 234*c* stops sucking toner particles from the toner cartridge 234 and supply of toner particles to the sieve device 100 is terminated.

According to some embodiments, the blade 131 is allowed to rotate even after toner supply to the sieve device 100 is stopped so that toner particles having been remaining on the filter 122 are discharged by rotation of the blade 131. Coarse toner particles remaining of the filter 122 without passing through it are moved to the frame 121 side by centrifugal force.

The drive control part 561 outputs a signal for stopping rotary drive of the blade 131 to the blade drive motor 141 ("step S22"). The blade drive motor 141 stops rotary drive of the rotator 130 based on the signal. The sieve device 100 stops supplying toner particles to the sub hopper 160. Since coarse toner particles have been moved to the frame 121 side by centrifugal force, it is easy to collect the coarse toner particles from the cleaning door 121*c*.

Figure 25:
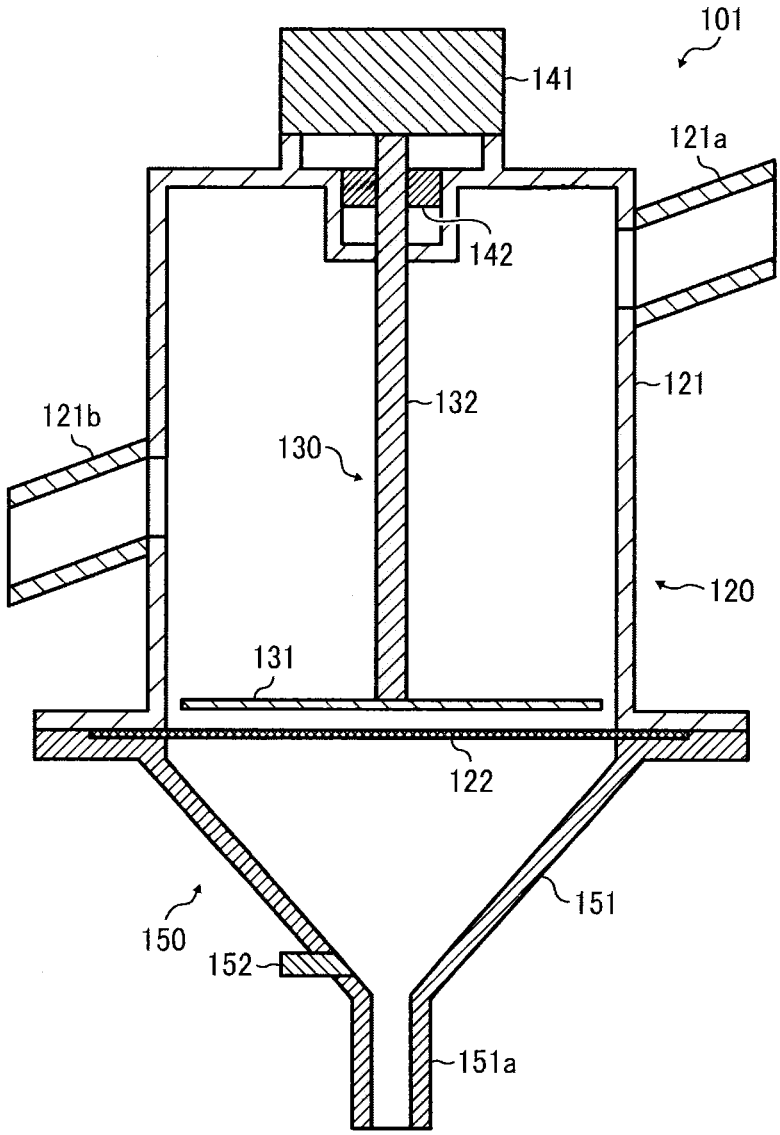
FIG. 25 is a cross-sectional view of a sieve device according to another embodiment.

FIG. 25 is a cross-sectional view of a sieve device according to another embodiment.

A sieve device 101 illustrated in FIG. 25 has the same configuration as the sieve device 100 illustrated in FIG. 5 except that a discharge part 121*b* is disposed at the frame 121.

The discharge part 121*b* discharges toner particles when the amount of toner particles accumulated on the filter 122 within the sieve body 120 exceeds a predetermined value. When the amount of toner particles supplied from the supply part 121*a* is kept in excess of the amount of toner particles passing through the filter 122, the amount of toner particles accumulating on the filter 122 keeps increasing. Even in such a case, because the discharge part 121*b* discharges excessive toner particles, the sieve device 101 provides a continuous operation with a high degree of sieving efficiency and a great capacity for an extended period of time.

The discharge part 121*b* is not limited in size, shape, configuration, and material so long as excessive toner particles can be discharged from the sieve body 120. The discharge part 121*b* may be comprised of, for example, metals (e.g., stainless steel, aluminum, iron) or resins (e.g., ABS, FRP, polyester resin, polypropylene resin). The discharge part 121*b* may be disposed at a side surface, an end surface, or a top surface of the frame 121. According to some embodiments, the sieve device 101 is configured to resupply toner particles discharged from the discharge part 121*b* to the supply part 121*a*.

Additional modifications and variations in accordance with further embodiments of the present invention are possible in light of the above teachings. According to some embodiments, in the sieve devices 100 and 101, the single blade 131 may be replaced with double blades 131 each disposed at the shaft 132 at different heights.

In the embodiments illustrated in FIG. 5 and FIG. 25, the filter 122 is disposed over the entire end surface of the sieve body 120. According to some embodiments, the filter 122 may be disposed only at a part of the end surface of the sieve body 120.

In the embodiments described above, the developing device 180 is supplied with toner particles from the sub hopper 160. According to some embodiments, the sub hopper 160 may be replaced with a pump (e.g., a bellows pump, a diaphragm pump, a snake pump), means of pneumatic transportation by compressed air, a coil screw, an auger, or a mechanism of supplying toner particles with their own weight.

In accordance with some embodiments, the sieve devices 100 and 101 are provided. Each of the sieve devices 100 and 101 includes the blade 131. The blade 131 is rotatable about the rotation axis Z that intersects with the filter 122 in proximity to the filter 122. The sieve devices 100 and 101 are adapted to sieve toner particles to remove coarse toner particles therefrom. The developing device 180 forms toner images with the toner particles having been sieved with the sieve device 100 or 101. The sieve device 100 and 101 prevent the developing device 180 from producing toner images with coarse toner particles. As the blade 131 rotates, toner particles are allowed to pass through the filter 122 while their direction of movement is restricted to a direction coincident with the rotation axis Z. Therefore, the sieve devices 100 and 101 do not require a large space for collecting toner particles passed through the filter 122. The image forming apparatus 1 does not get larger by installation of such a compact sieve device 100 or 101. The sieve devices 100 and 101 perform sieving by driving the blade 131 without vibrating the filter 122. Thus, undesirable toner supply which may be caused by vibration of the filter 122 after shutdown does not occur in the sieve devices 100 and 101.

The nozzle 151 of the sieve device 100 or 101 has a fit part 151*a* fittable into the inlet aperture Al of the sub hopper 160. Such a configuration makes toner particles sieved with the filter 122 promptly introduced into the sub hopper 160.

As the blade 131 rotates in the sieve device 101 or 101, toner particles are fluidized. When the fluidized toner particles Pf fall down by their own weight, small toner particles Ps are allowed to pass through the filter 122 with a high degree of efficiency and a low level of stress. The sieve devices 100 and 101 are smaller than other sieve devices having a similar level of efficiency. Therefore, the image forming apparatus 1 does not get larger by installation of such a compact sieve device 100 or 101.

The nozzle 151 is equipped with the toner sensor 152 that detects toner particles passed through the filter 122. When the toner sensor 152 is not detecting toner particles ("NO" in the step S11), the sieve device 100 or 101 starts feeding toner particles.

The cleaning door 121*c* is disposed to the frame 121 of the sieve devices 100 and 101. While the sieve device 100 or 101 is not operating, the cleaning door 121*c* is opened to define an aperture and toner particles remaining on the filter 122 are removed through the aperture.

In the sieve device 101, the discharge part 121*b* is disposed at the frame 121. Since excessive toner particles and air are discharged from the sieve body 120 through the discharge part 121*b*, the sieve device 101 provides a continuous operation for an extended period of time.

In the sieve devices 100 and 101, the thickness Dz of the blade 131 is smaller than the length Dx of the blade 131 in a tangential direction of rotation of the blade 131. With such a configuration, when the blade 131 rotates in a certain direction, vortexes are generated at the trailing-edge side thereof in its moving direction.

According to some embodiments, the distance between the blade 131 and the filter 122 is 5 mm or less. With such a configuration, when the blade 131 rotates in a certain direction, vortexes are generated at the trailing-edge side thereof in its moving direction and the vortexes easily reach the filter 122. Therefore, toner particles accumulated on the filter 122 are fluidized sufficiently.

In the sieve devices 100 and 101, the blade 131 is attached to the shaft 132 that is disposed coincident with the rotation axis Z. The blade 131 rotates about the rotation axis Z precisely.

In the sieve devices 100 and 101, an end part of the blade 131 is in proximity to the frame 121. Even when toner particles are drawn toward the frame 121 by centrifugal force generated by rotation of the blade 131, vortexes generated by rotation of the blade 131 easily reach such toner particles because the blade 131 moves in proximity to the frame 121 above the filter 122. Thus, toner particles can be sieved with a high level of efficiency.

What is claimed is:

1. A sieve device, comprising:

a sieve body including:

a cylinder adapted to be supplied with toner particles;

a filter disposed at a bottom of the cylinder; and a blade adapted to agitate the toner particles within the cylinder to allow the toner particles to pass through the filter, the blade being rotatable about a rotation axis that intersects with the filter, and the blade is in proximity to the filter with a distance between a surface of the blade facing the filter and a surface of the filter facing the blade being within a range greater than 0 mm and not greater than 5 mm, so that the blade generates a vortex that reaches the filter when the blade is rotated; and an introduction pipe adapted to introduce the toner particles passed through the filter outside the sieve body.

2. The sieve device according to claim 1, wherein the introduction pipe is comprised of a nozzle.

3. The sieve device according to claim 1, wherein the cylinder includes a door being openable to define an aperture and closable to close the aperture, and the toner particles within the cylinder are collectable through the aperture.

4. A supply unit, comprising:

the sieve device according to claim 1; and a supply device, the supply device being connected to the introduction pipe so that the toner particles passed through the filter are introduced into the supply device.

5. The supply unit according to claim 4, wherein the supply device includes:

a supply main body including:

a bottom plate having a supply aperture for supplying the toner particles passed through the filter outside the supply unit;

a supply cylinder disposed to stand around the bottom plate; and a top plate disposed at an upper opening of the supply cylinder, the top plate having an inlet aperture for introducing the toner particles passed through the filter into the supply cylinder; and a conveyer adapted to convey the toner particles introduced from the inlet aperture to the supply aperture.

6. A developing unit, comprising:

the supply unit according to claim 5; and a developing device adapted to develop an electrostatic latent image into a toner image with the toner particles supplied from the supply unit.

7. An image forming apparatus, comprising:

the developing unit according to claim 6;

a transfer roller adapted to transfer the toner image onto a recording medium; and a fixing roller adapted to fix the toner image on the recording medium.

8. The sieve device according to claim 1, wherein a distance between an end surface of the blade and an inner surface of the cylinder is not greater than 5 mm.

9. The sieve device according to claim 1, wherein a thickness of the blade is not greater than 10 mm.

10. The sieve device according to claim 1, wherein a thickness of the blade is smaller than a length of the blade in a tangential direction of rotation of the blade.

11. The sieve device according to claim 1, wherein an angle of the blade relative to a plane of the filter is within a range of −3 to 10 degrees.

12. The sieve device according to claim 1, wherein a ratio $(X/Y)\times 100$ of an area X defined by a rotation trajectory of the blade to an area Y of the filter, is within a range of 60 to 150%.

13. The sieve device according to claim 1, wherein an inner diameter of the cylinder is 10 to 300 mm.

14. The sieve device according to claim 1, wherein the blade is rotatable at a circumferential speed within a range of 3 to 30 m/s.

15. A method of supplying toner particles, comprising:

supplying toner particles to a sieve body including a cylinder, a filter disposed at a bottom of the cylinder, and a blade;

agitating the toner particles within the cylinder by rotating the blade about a rotation axis that intersects with the filter in proximity to the filter to allow the toner particles to pass through the filter, the blade being in proximity to the filter with a distance between a surface of the blade facing the filter and a surface of the filter facing the blade being within a range greater than 0 mm and not greater than 5 mm, so that the blade generates a vortex that reaches the filter when the blade is rotated; and supplying the toner particles passed through the filter to a developing device adapted to develop an electrostatic latent image into a toner image with the toner particles.

16. The method according to claim 15, further comprising:

previously rotating the blade before the toner particles are supplied to the sieve body.

* * * * *